US007972040B2

(12) United States Patent
Li et al.

(10) Patent No.: US 7,972,040 B2
(45) Date of Patent: Jul. 5, 2011

(54) LED LAMP ASSEMBLY

(75) Inventors: Qing Charles Li, Blacksburg, VA (US); Yangcheng Huang, Foshan (CN); Haijun Wang, Foshan (CN); Cuie Wei, Foshan (CN); Guohong Huang, Foshan (CN)

(73) Assignees: Virginia Optoelectronics, Inc., Blacksburg, VA (US); Foshan Nationstar Optoelectronics Co., Ltd. Corp. (CN)

( * ) Notice: Subject to any disclaimer, the term of this patent is extended or adjusted under 35 U.S.C. 154(b) by 48 days.

(21) Appl. No.: 12/545,160

(22) Filed: Aug. 21, 2009

(65) Prior Publication Data

US 2010/0046223 A1 Feb. 25, 2010

Related U.S. Application Data

(60) Provisional application No. 61/091,072, filed on Aug. 22, 2008.

(51) Int. Cl.
*F21V 33/00* (2006.01)

(52) U.S. Cl. ..... 362/311.02; 362/237; 362/238; 362/249.02

(58) Field of Classification Search ..... 362/236, 362/237, 238, 240, 249.02, 311.02
See application file for complete search history.

(56) References Cited

U.S. PATENT DOCUMENTS

| | | | | |
|---|---|---|---|---|
| 7,549,774 | B2 | 6/2009 | Tsai | |
| 2006/0013014 | A1 * | 1/2006 | Hayman et al. | 362/572 |
| 2008/0123341 | A1 * | 5/2008 | Chiu | 362/294 |
| 2008/0278946 | A1 | 11/2008 | Tarter et al. | |

FOREIGN PATENT DOCUMENTS

| | | | |
|---|---|---|---|
| CN | 2926800 | Y | 7/2007 |
| CN | 201259122 | Y | 6/2009 |

* cited by examiner

*Primary Examiner* — Laura Tso
(74) *Attorney, Agent, or Firm* — New River Valley IP Law; Michele L. Mayberry

(57) ABSTRACT

The present invention relates to lighting assemblies and more particularly to light emitting diode (LED) light bulbs comprising a support for one or more LED lenses, which can be used to position and support the lenses within the lamp housing and which facilitate assembly of the light bulbs during manufacturing.

22 Claims, 18 Drawing Sheets

LED LAMP ASSEMBLY

CROSS-REFERENCE TO RELATED APPLICATIONS

This application relies on the disclosure and claims the benefit of the filing date of U.S. Provisional Application No. 61/091,072 filed Aug. 22, 2008, the disclosure of which is hereby incorporated by reference in its entirety.

BACKGROUND OF THE INVENTION

1. Field of the Invention

The present invention relates to lighting assemblies and more particularly to light bulbs comprising a support for one or more light emitting diode (LED) lenses, which can be used to position and support the lenses within a lamp housing and which facilitate assembly of the light bulbs during manufacturing.

2. Description of the Related Art

Spot light type bulbs are well known and are available in many formats, including bulbs with halogen or LED light sources. Typical formats include MR and PAR series in various sizes. Very generally, the number of the series (for example, MR 16) corresponds with the number of eighth-inch increments in the diameter of the lamp at its widest point. For example, the housing of an MR 16 lamp is typically about 16 eighths of an inch in diameter, or 2 inches. The present invention is applicable to any lamp type, including any MR or PAR series lamp of any size.

These lamps usually comprise a housing, a light source or multiple light sources operably connected to an electrically conductive pathway which is operably connected to a power source to provide electricity to the light source(s), one or more lenses and/or reflectors to guide and/or modify the light as desired, and a cover plate (housing cap) to secure within and protect the internal components of the housing, such as the light sources and electrical components. In the case of LED light sources, printed circuit boards (PCBs) are typically employed as an electrically non-conductive substrate to house part of the electrically conductive pathway for the lighting system.

Where one or more lenses or reflectors is used to control the direction and/or appearance of the light from the light source(s) and where the lenses or reflectors are not integral with or secured to or within the housing, it can be difficult to assemble such lamps during the manufacturing process. In particular, it has been found to be difficult, labor intensive, and time consuming to install the internal components within the lamp housing, especially in the situation where there are numerous individual components. For example, in a light bulb having ten LEDs and ten corresponding individual lenses, one for each LED, it becomes an impossible if not laborious and time-consuming task to position and secure each lens in the appropriate place within the bulb housing. The present invention makes it easier to manufacture such lamp assemblies by providing a lens support to cradle the individual lenses. Manufacturing of such lamps using these improved lamp assemblies can thus speed up the manufacturing process, simplify the process, and/or allow for concurrent installation of the lenses within the lamp housing.

More particularly, spot light type lamps that are assembled by hand are usually held in one hand by the housing while the components of the lamp are installed into the housing with the other hand. Specifically, while the housing is held in one hand a PCB board with LEDs installed on it can be operably connected to the electrical components within the lamp housing and positioned/secured in place. Next the lenses and/or reflectors can be appropriately positioned with respect to the LEDs. When multiple lenses are installed, each individual lens is typically inserted with one hand and then balanced in place with the installer's free fingers on the other hand being used to hold the housing. This process becomes increasing complex as the number of lenses increases and as the installer runs out of available fingers to support the lenses. Even if the lenses are capable of supporting themselves or combined with individual supports, such as cups, within the housing, the inventors have found that manufacturing time is increased by virtue of having more components than are needed.

Once the lenses are in the desired position with respect to the LEDs, a cover to the lamp housing is installed to secure the lenses in place and protect them and other internal components from environmental elements. Often the installers will encounter difficultly in keeping the lenses in the appropriate position while installing the cover plate. For example, if even one lens of a 10-lamp bulb slips out of position during this process the entire process must be halted so that the lens can be repositioned before the cover plate is installed. Often times, especially with numerous individual lenses being installed, the assembly process must be stopped and re-started multiple times. Additionally, lenses of existing lamp assemblies can shift within the lamp housing over time and cause a decrease in luminous efficiency due to the lenses tilting out of alignment with the light sources because of insufficient support within the lamp housing. Even further, there are no known devices with lens supports that encompass the side surface of the lenses in their entirety, which further guides the light as desired and increases the luminous efficiency of the device. Further, although in the past it has been preferable to have components that can be used with any spot light type bulb system, the inventors have found that this modular benefit is provided at the expense of increased manufacturing time and an overall more complex manufacturing system. Thus, a light assembly that simplifies the manufacturing process is greatly needed.

SUMMARY OF THE INVENTION

Embodiments of the present invention provide lighting assemblies that address some of the deficiencies described above and improve the manufacturing process for spot-light type light bulbs. The present invention provides embodiments of light assemblies that improve existing manufacturing processes by providing lens support(s) and complementary shaped individual lenses. As is explained in more detail below, the lens support(s) can be of unitary or single-piece construction or a combination of individual, releasably connectable supports, so as to provide an integral, unitary lens support with multiple supports joined.

Advantages of embodiments of the invention can include the capability of installing multiple lenses simultaneously, by placing the lenses in the unitary support then installing the support in the housing, or the capability of maintaining the position of installed lenses while installing additional lenses within the housing, by installing the unitary support in the housing then installing the individual lenses in the support. Individual supports, one for each lens, can also be used.

One object of embodiments of the present invention is to provide light assemblies comprising: (a) a housing optionally comprising heat sink capabilities; (b) an electrically non-conductive substrate with an electrically conductive pathway; (c) one or more light emitting diodes (LEDs) operably connected to the pathway; (d) a lens for each LED; (e) a lens support having a through hole for each LED and a recess for each lens, wherein each recess is capable of supporting each lens; and (f) a cover plate for securing the lenses and lens support within the housing.

Another object of embodiments of the invention is to provide a light assembly as described above wherein each lens is an individual lens.

Still further, embodiments include light assemblies, wherein the lens support comprises multiple individual lens supports joined together to form an integral lens support having multiple recesses. The multiple individual lens supports, or cups, can be joined together with releasable connections, such as quick connect and disconnect features. Even further, the lens support can be of single-piece construction.

Embodiments include such light assemblies, wherein each recess of the lens support has an interior surface shape and each lens has an exterior surface shape and wherein the shapes are complementary. Further, the interior surface shape of each recess can match the exterior surface shape of each lens.

Light assemblies of embodiments according to the invention can also comprise recesses in the lens support that are capable of slideable and/or releasable engagement with a corresponding lens. For example, matching shapes can include embodiments where the interior surface of the recess and the exterior surface of the lens each have a conical shape. Such a conical shape would allow for the lens to be inserted and removed from the lens support readily easily. Any other equivalent shape, which allows for releasable engagement between the lens and lens support, is also within the scope of the invention.

Preferred is a light assembly comprising: (a) a housing optionally comprising heat sink capabilities; (b) an electrically non-conductive substrate with an electrically conductive pathway; (c) one or more light emitting diodes (LEDs) operably connected to the pathway; (d) a lens for each LED having a lower exterior surface; (e) a lens support having an upper exterior surface, a recess for each lens, and a through hole for each LED, wherein when assembled the lower exterior surface of each lens contacts the upper exterior surface and a recess of the lens support; and (f) a cover plate for securing the lenses and lens support within the housing. Further preferred is such a light assembly wherein the lower exterior surface of each lens is complementary in shape to the upper exterior surface and recess of the lens support. Even further preferred is such a light assembly, wherein an outline of the exterior surface shape of each lens matches an outline of the upper exterior surface and a recess of the lens support. Especially preferred are embodiments wherein when assembled the lens(es) are seated within the lens support (reflector) totally (meaning the side surface of the lens fits completely within the recess of the lens support) to provide for better positioning of the lenses with respect to the light sources.

Light assembly embodiments of the invention lamps having heat sink capabilities are also included. Common heat-sink type materials include ceramics, metals, such as aluminum, and metal alloys or composites, such as those comprising aluminum and copper, but plastic can also be used. In particular, embodiments of the invention include lamp housings comprising thermally conductive plastics as a plastic type heat sink. Even further, embodiments can incorporate heat pipe technology ar part or all of the heat sink features, such as that provided by Celsia Technologies and described in U.S. Patent Application Publication No. 2007/0295494.

Lamps according to embodiments of the invention can comprise any number of light sources. Of particular interest are lamps comprising up to 10 LEDs, more particularly for example from 3 to 10 LEDs. Such lamps can also comprise a lens support member having an equal number of recesses to support an equal number of corresponding lenses. Even further, for example, embodiments can include light assemblies comprising from 5 to 10 LEDs, a lens support with an equal number of recesses, and an equal number of lenses.

Methods of manufacturing a lighting assembly are also included as embodiments of the invention. Such methods can comprise: (a) installing one or more individual lenses in a light assembly housing by placing each lens in a recess of a lens support, wherein each recess has an interior surface shape complementary to an exterior surface shape of the lens; and (b) installing a cover plate to secure the lenses and lens support within the housing.

In embodiments of the manufacturing methods of the invention, lens supports and lenses can be used in which the interior surface shape of each lens support recess matches the exterior surface shape of each lens.

Still further, the lens support can comprise multiple individual lens supports joined together to form an integral lens support having multiple recesses, optionally where the individual lens supports are joined together with releasable connections, or the lens support can be of single-piece construction.

Additionally, the lamp assemblies according to the invention and the manufacturing processes for providing such lamps can comprise lens supports, wherein each recess and corresponding lens are capable of slideable and releasable engagement.

Heat sinks are also included as embodiments of the invention. For example, a heat sink for a lamp assembly comprising thermally conductive plastic(s) material and configured as in any of FIGS. 13-18 is an embodiment of the invention. Preferred is a heat sink for a lamp assembly comprising polyamide or polyphenyl sulfide disposed in any combination of ridges, troughs, and vents to provide for a housing having a heat sink surface area that is twice or greater than and up to ten times that of a lamp assembly of the same size without ridges, troughs, or vents.

DETAILED DESCRIPTION OF VARIOUS EMBODIMENTS OF THE INVENTION

Figure 1A:
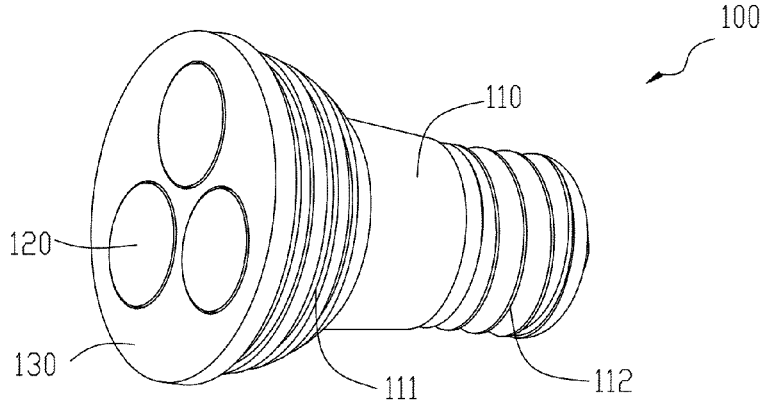
FIG. 1A shows an exemplary embodiment of a PAR-16 type light assembly according to the invention with the components assembled.

Reference will now be made in detail to various exemplary embodiments of the invention. The following detailed description is presented for the purpose of describing certain embodiments in detail and is, thus, not to be considered as limiting the invention to the embodiments described. Additionally, any features of any embodiment described herein are equally applicable to any other embodiment described herein or envisioned by one of ordinary skill in the art. Thus, the detailed descriptions provided herein should not be construed to exclude features otherwise described with respect to another embodiment.

Included in embodiments of the invention are lamp assemblies that provide for various forms of light. More particularly, and as will be described further below, features of lamp assemblies according to the invention can include, for the MR 16 lamps, 12V AC/DC input; with a color temperature range of approximately 2800K to 7500K; a standard GU5.3 two-pin MR 16 base or other appropriate base such as GU10, E26, and E27; brightness in the range of approximately 20-500 lm; a viewing angle in the range of approximately 6-120 degrees; lenses with a concave or convex configuration; as well as such assemblies appropriate for voltages of 12 VAC/VDC.

PAR 16 lamps according to embodiments of the invention can have for example 85-250 V AC input; with a color temperature range of approximately 2800K to 7500K; a standard E26/E27 base; brightness in the range of approximately 20-500 lm; a viewing angle in the range of approximately 6-120 degrees; lenses with a concave or convex configuration; and such assemblies appropriate for use with voltages of 12 VAC/VDC, 24 VAC/DC, 120 VAC, and 277 VAC.

PAR 20 lamp embodiments of the invention can have for example an AC input ranging from 85-130V or 210-277 V; with a color temperature range of approximately 2800K to 7500K; a standard E26 or E27 base; brightness in the range of approximately 20-1000 lm; a viewing angle in the range of about 6-120 degrees; lenses with a concave or convex configuration; and such assemblies appropriate for use with voltages of 12 VAC/VDC, 24 VAC/DC, 120 VAC, and 277 VAC.

Features of the PAR 30 lamp embodiments according to the invention can include 85-277 V AC input; with a color temperature range of approximately 2800K to 7500K; a standard E26 or E27 base; brightness in the range of about 20-2000 lm; a viewing angle in the range of approximately 6-120 degrees; lenses with a concave or convex configuration; and such bulbs appropriate for use with voltages of 12 VAC/VDC, 24 VAC/DC, 12 VAC, and 277 VAC.

Likewise, features of lamp assemblies according to the present invention can include, for the PAR 38 lamps, 85-277 V AC input; with a color temperature range of approximately 2800K to 7500K; a standard E26 or E27 base; brightness in the range of approximately 20-3000 lm; a viewing angle in the range of about 6-120 degrees; lenses with a concave or convex configuration; and such bulbs for use with voltages of 12 VAC/VDC, 24 VAC/DC, 120 VAC, and 277 VAC.

Numerous factors are considered in manufacturing LED lighting devices, including finding ways of increasing heat dissipation to keep the devices cooler, increasing life of the bulb, increasing brightness of the bulb(s), decreasing the amount of current required to operate the bulb(s), decreasing cost, and decreasing the overall weight of the device. Often some of these advantages can be gained but only at the expense of other of these advantages. For example, one way to increase the dissipation of heat from the lighting devices is to increase the surface area of the heat sink. An increase in the surface area of the heat sink, however, also increases the size of the heat sink, which usually results in an unfavorable increase in the weight of the overall device. Similarly, the amount of heat output can be decreased by decreasing the current, but this usually results in a decrease in the brightness of the bulb, which is usually disfavored by the consumer. It is thus a challenge to find the optimum combination and arrangement of materials which will result in a favorable product.

The absolute maximum ratings of the exemplary inventive MR 16, PAR 16, PAR 20, PAR 30, and PAR 38 lamps include those specified in Table 1, which are characteristics of the bulbs using VaOpto LEDs. The characteristics of bulbs with other LEDs may be slightly different.

TABLE 1

Absolute Maximum ratings for MR-16, PAR-16, 20, 30, 38

| Parameter | Rating | Unit | Condition |
|---|---|---|---|
| | MR-16 | | |
| DC | 12 | V | Ta: 25° C. |
| AC | 12 | V | (77° F.) |
| Forward Current | 330 | mA | |
| Operating Temperature | −40~+85 (−40~185) | ° C. (° F.) | |
| Storage Temperature | −40~+100 (−40~212) | ° C. (° F.) | |
| Median Life Expectancy | 50,000 | Hours | |
| Median Life Expectancy | 10,000 | Hours | Ta: 50° C. (122° F.) |
| | PAR-16 | | |
| AC | 85-250 | V | Ta: 20° C. |
| Forward Current | 330 | mA | |
| Operating Temperature | −40~+85 | ° C. | |

TABLE 1-continued

| Absolute Maximum ratings for MR-16, PAR-16, 20, 30, 38 | | | |
|---|---|---|---|
| Parameter | Rating | Unit | Condition |
| Storage Temperature | −40~+100 | ° C. | |
| Median Life Expectancy | 50,000 | Hours | |
| Median Life Expectancy | 10,000 | Hours | Ta: 50° C. |
| | PAR-20 | | |
| AC | 85-130 | V | Ta: 20° C. |
| | 210-277 | V | |
| Forward Current | 430 | mA | |
| Operating Temperature | −40~+85 | ° C. | |
| Storage Temperature | −40~+100 | ° C. | |
| Median Life Expectancy | 50,000 | Hours | |
| Median Life Expectancy | 10,000 | Hours | Ta: 50° C. |
| | PAR-30 and PAR-38 | | |
| AC | 85-277 | V | Ta: 20° C. |
| Forward Current | 300 | mA | |
| Operating Temperature | −40~+85 | ° C. | |
| Storage Temperature | −40~+100 | ° C. | |
| Median Life Expectancy | 50,000 | Hours | |
| Median Life Expectancy | 10,000 | Hours | Ta: 50° C. |

Electro-optical characteristics of lamp assemblies according to embodiments of the invention can for example include those specified in Table 2. The characteristics described are reflective of bulbs using VaOpto LEDs and may be different when other LEDs from other manufacturers are used.

TABLE 2

| MR-16, PAR-16, 20, 30, 38 Electro-Optical Characteristics | | | | | |
|---|---|---|---|---|---|
| Parameter | Symbol | Min. | TYP. | Max. | Unit |
| | | MR-16 | | | |
| Viewing Angle | 2T½ | — | 60 | — | Deg. |
| Luminous Flux | Flux | 130 | 150 | 180 | Lm |
| Correlated Color Temperature CW | CCT | 6000 | 6500 | 7000 | K |
| Correlated Color Temperature NW | CCT | 3800 | 4100 | 4500 | K |
| Correlated Color Temperature WW | CCT | 2700 | 3500 | 3800 | K |
| Operating Current | Lin | 300 | 330 | 360 | mA |
| | | PAR-16 | | | |
| Viewing Angle | 2T½ | — | 30 | — | Deg. |
| Correlated Color Temperature CW | CCT | 6000 | 6500 | 7000 | K |
| Correlated Color Temperature NW | CCT | 3800 | 4100 | 4500 | K |
| Correlated Color Temperature WW | CCT | 2700 | 3500 | 3800 | K |
| Operating Current | Lin | 300 | 330 | 360 | mA |
| | | PAR-20 | | | |
| Viewing Angle | 2T½ | — | 30 | — | Deg. |
| Correlated Color Temperature CW | CCT | 6000 | 6500 | 7000 | K |
| Correlated Color Temperature NW | CCT | 3800 | 4100 | 4500 | K |
| Correlated Color Temperature WW | CCT | 2700 | 3500 | 3800 | K |
| Operating Current | Lin | 420 | 430 | 450 | mA |
| | | PAR-30 | | | |
| Viewing Angle | 2T½ | — | 30 | — | Deg. |
| Correlated Color Temperature CW | CCT | 6000 | 6500 | 7000 | K |
| Correlated Color Temperature WW | CCT | 2700 | 3000 | 3500 | K |
| Operating Current | Lin | 300 | 330 | 360 | mA |

TABLE 2-continued

| MR-16, PAR-16, 20, 30, 38 Electro-Optical Characteristics | | | | | |
|---|---|---|---|---|---|
| Parameter | Symbol | Min. | TYP. | Max. | Unit |
| | | PAR-38 | | | |
| Viewing Angle | 2T½ | — | 30 | — | Deg. |
| Correlated Color Temperature CW | CCT | 6000 | 6500 | 7000 | K |
| Correlated Color Temperature WW | CCT | 2700 | 3000 | 3500 | K |
| Operating Current | Lin | 380 | 400 | 420 | mA |

Even more particularly, exemplary lamp assemblies according to the invention are described in further detail below with reference to FIGS. 1-10.

FIG. 1A shows an exemplary embodiment of a PAR-16 type light assembly 100 according to the invention with the components assembled. As shown, bulb 100 comprises a housing 110 comprising heat sink material 111. This embodiment of the PAR-16 bulb comprises three light sources (not visible) with three corresponding individual lenses 120. The lenses 120 are held in place within the housing by a cover plate 130. This bulb 100 has an incandescent-compatible plug end 112.

Light bulbs with high heat output, for example MR and PAR series bulbs, typically comprise a housing 110 with heat sink 111 capabilities to remove heat from the bulb that is generated by the light source. It is a general rule that the greater the number of light sources or the total wattage of the light sources, then the greater the heat that is generated by the bulb. This heat, if left within the bulb system, can lead to overheating of the lighting unit, which in turn can lead to failure of the bulb or the lighting unit, as well as to various heat-related hazards, including fire.

A further aspect of the present invention includes various lamp housings having innovative heat sink capabilities. Various types of heat sink features are known and include using materials and/or configurations that provide for heat dissipation from the bulb. For example, part of the light assembly housing 110 can comprise ceramic, metal, alloy, or metal composite material, the composition of which promotes dissipation of heat from light assembly 100 during operation. Metals with high thermal conductivity are preferred, including iron, copper, aluminum, silver, gold, and alloys or composites comprising them. A preferred material for heat sinks is aluminum or an aluminum and copper combination, such as an alloy. This invention also comprises heat sinks 111 constructed of thermally conductive polymers, which are lightweight and moldable and which exhibit high heat transfer characteristics. Exemplary materials include polyamide and polyphenylene sulfide materials, such as CoolPoly E3603 and E5101 manufactured by Cool Polymers, Inc. Such materials are favorable due to their thermal conductivity (20 W/mK) and thermal diffusivity (0.12 $cm^2$/sec) characteristics. Heat sinks 111 of embodiments of the invention can also include heat transfer devices, such as the NanoSpreader provided by Celsia Technologies, which is an ultra-thin heat pipe comprising a copper encased two-phase vapor chamber.

The heat sink 111 can be constructed so as to provide for and facilitate heat dissipation by way of maximizing the surface area of the heat sink 111. There exist numerous structures capable of dissipating heat in this way, including incorporating multiple metal structures or a structure shaped to provide rows of material with air space between the rows, which extend lengthwise along or circumferentially around housing 110. The rows of material are preferably constructed of high conductivity materials for pulling heat out of the light assembly 110 system and radiating it into the environment over the material's large surface area. In particular, for example, a heat dissipation module as described in U.S. Pat. No. 7,549,774 could be used as heat sink 111 in embodiments of the light assemblies 100 according to this invention. Such shapes are likewise equally applicable to plastic-based heat sinks.

The lamp assemblies 100 of the present invention are applicable to any spot light type bulb, for example, MR 16, PAR 16, PAR 20, PAR 30, PAR 38, and PAR 56, to name a few, and can be used in place of any existing equivalent bulb.

Accordingly, the base 112 of the light assemblies 100 of the present invention can also be constructed or modified to cooperate with any existing bulb type lighting fixture. For example, the bulbs 100 of the present invention can comprise a base 112 having a 2-pin configuration, and turn-and-lock configuration, a screw-type base (as shown), or a bayonet-type base to name a few. One of skill in the art could use an existing plug-type end 112 on the light assemblies 100 for compatibility with any corresponding socket.

Figure 1B:
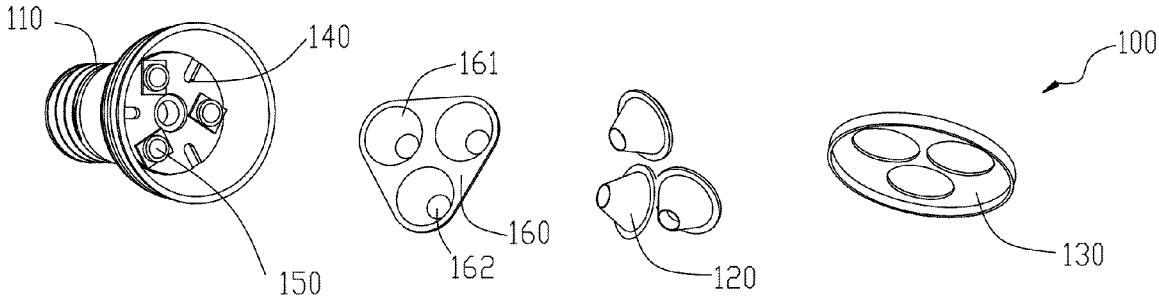
FIG. 1B shows an exemplary embodiment of a PAR-16 type light assembly according to the invention with the components unassembled.

FIG. 1B shows an exemplary embodiment of a PAR-16 type light assembly according to the invention with the components unassembled. As shown, within housing 110 is a PCB 140 operably connected to the electrical components (not shown) of the bulb 100. Operably connected to the PCB 140 are three LEDs 150. Lens support 160 is configured with three recesses 161 for supporting lenses 120. At the base of the support 160 within the recesses 161 are three through holes 162. The through holes 162 allow for placement of support 160 over LEDs 150. In this embodiment, when support 160 is placed within housing 110 on PCB 140, LEDs 150 protrude into the space defined by the recesses 161 and support 160 thereby surrounds LEDs 150. Lenses 120 can then be easily and conveniently inserted into housing 110 by placing lenses 120 in support 160. Cover plate 130 can then be positioned over lenses 120 and support 160 and secured to housing 110.

Figure 2A:
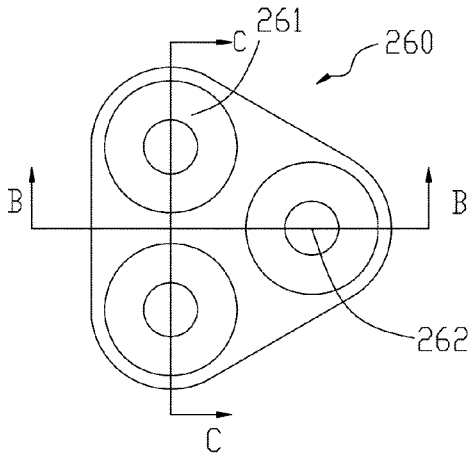
FIGS. 2A-2E show various views of an exemplary lens support according to embodiments of the invention having three recesses for supporting three lenses.

FIGS. 2A-2E show various views of an exemplary lens support according to embodiments of the invention having three recesses for supporting three lenses. FIG. 2A is a top plan view of an exemplary unitary 3-recess support 260. Each of the recesses 261 is capable of supporting an individual lens, in this embodiment up to and including three lenses could be used. At the base of support 260 and within each recess 261 is a through hole 262 for accommodating a light source.

Figure 2B:
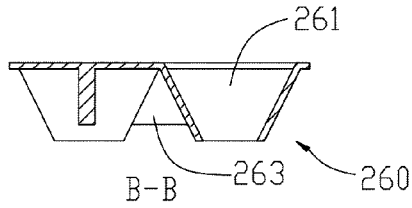

FIG. 2B is a cross-sectional view of support 260 taken along cross-sectional line B-B in FIG. 2A. As shown, support 260 comprises recesses 261 with a conical interior surface shape. This embodiment of unitary support 260 also shows structural support members 263 between the outside surfaces of recesses 261.

Figure 2C:
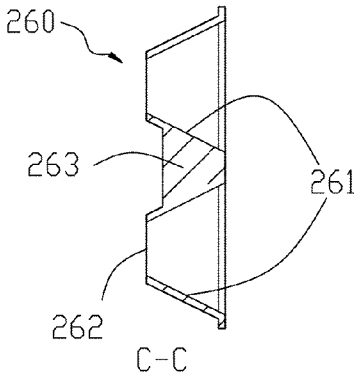

FIG. 2C provides a cross-sectional view of support 260 taken along cross-sectional line C-C in FIG. 2A. As shown, the structural support members 263 can comprise material between recesses 261 which extends from the top of the outside surface of the recess to a point along the outside surface of the recess. In embodiments, it may be desired to have the support 263 end at a point above the through holes 262 so that when assembled there is sufficient clearance above the PCB for supports 263 to not interfere with components mounted on the PCB, such as electrical contacts for providing electrical power to the electrical circuit of the PCB during use of the bulb. Support 260 can also be constructed of more rigid material to obviate the need for additional structural supports 263 or supports 263 can comprise a build up of material strategically placed between the outside surfaces of recesses 261.

Figure 2D:
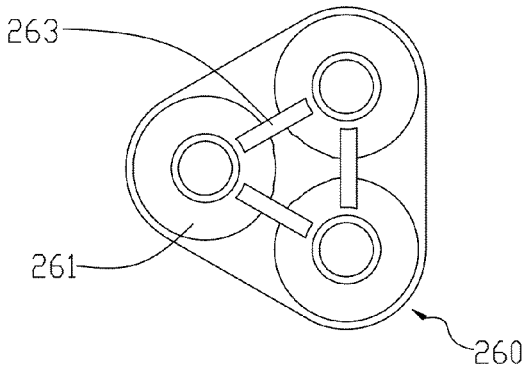

FIG. 2D shows a bottom plan view of support 260. As shown, embodiments of support 260 can comprise structural support members 263 that are strips of material between the outside surfaces of recesses 261. Support members 263 can be of any shape, size, or material, with low-profile configurations being preferred to reduce or eliminate interference with other components within the light assembly housing, such as components mounted to the PCB.

Figure 2E:
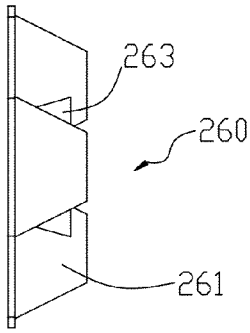

FIG. 2E shows a side elevation view of an embodiment of support 260 with three recesses 261 supported by additional structural support members 263.

The lens support 260 can comprise any material suitable for installation within a lamp housing. In particular, the material is preferably able to withstand high heat output from a light source or several light sources. Materials that can be used include metals, such as copper and aluminum, and plastics, including ABS plastic. The materials identified here are only examples of the many types of materials that can be used and it will be apparent to one of skill in the art which materials are best suited for a particular purpose. The lens support 260 may be used with or without lenses and, depending on its composition and/or surface characteristics, may be used as a reflector of light from the light source, as an absorber of light from the light source, or may be used to enhance the reflectivity or absorption of the light in combination with lenses. Accordingly, the lens support 260 can also be referred to as a reflector, as it can be used alone or in combination with lenses to direct the light from the light source. Further, the support can be shaped so as to guide the light from the light source in the desired direction. Generally, the support comprises a number of recesses or cups that corresponds with the number of light sources used in the lighting apparatus. For example, for MR 16 type lamps with three light sources, the support will typically comprise three recesses when the lamp is assembled. At the bottom of each lens support recess 261 is a void or through hole 262 large enough to accommodate the light source to enable the light source to protrude into the recess of the support and be encompassed by the surface(s) 261 of the recess. The shape of through hole 262 is not critical, so long as it is large enough to allow the light source to be surrounded by the recess. The recesses 261 in the lens support 260 need not be the same shape or of any particular shape, however, a generally conical shape is preferred, for example, with the bottom of the recess (where the void for accommodating the light source is located) being smaller than the top of the recess. In this manner, light from the light source can be directed out of the lamp assembly housing in a particular direction. Changing the slope of surface 261 can alter the path or coverage of the light being emitted from the lamp during use. Of course, one of skill in the art will recognize the many variations available for adjusting the size and shape of the recess(es) to control the direction and intensity of the light as desired.

It is preferred that the lens support 260 be shaped to accommodate a lens or lenses such that the lenses rest within the recesses 261 loosely enough to allow for the lenses to be inserted and removed from the recesses 261 freely. A preferred embodiment includes using lenses having an outer surface shape that corresponds with the inner surface shape of the recess. For example, a recess could be configured to be of conical shape in order to accommodate a conical-shaped lens. The more complementary the surfaces of the lens and recess are, the less the lens will move within the recess, thus, facilitating installation of the lens in the lamp housing because the lens will be stabilized temporarily for alignment with the corresponding voids of the housing cover plate, which is installed over the lenses.

Additionally, the lens support, whether used alone or in combination with lenses, can be constructed of a reflective material, coated with a material to reflect light, and/or comprise a surface that absorbs light so as to provide control over the amount and direction of the light from each of the light sources.

Embodiments of lens support 260 include multiple individual cups each comprising a recess 261 and means for connecting the cups together to form an integrated lens support 260. In this manner, lens supports 260 are modular and can be used in any type bulb assembly with any number of light sources. It is preferred that the means for connecting the cups 260 together be a quick connect-disconnect to add to the ease of modularity of the components. The cups 260 may also be irremovably or connectable (e.g., using adhesive) or otherwise difficult to disconnect so that once several cups are combined and integrated into a single lens support member 260 for a particular application, they are fixed in that configuration.

Figure 3A:
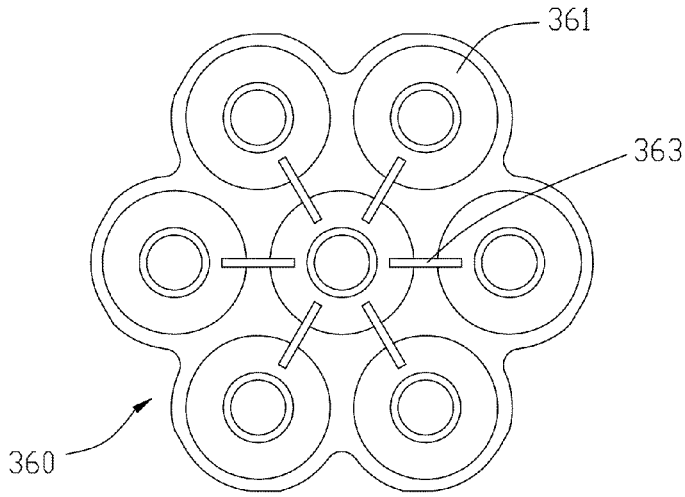
FIGS. 3A-B show bottom plan and side elevation views of an exemplary lens support according to embodiments of the invention having seven recesses for supporting seven lenses.
Figure 3B:
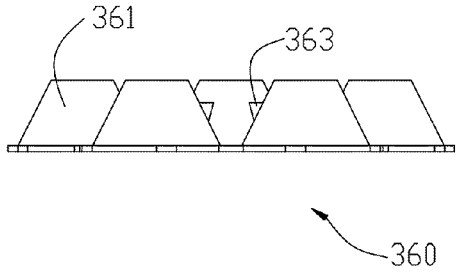

FIG. 3A shows a bottom plan view of an exemplary lens support 360 according to embodiments of the invention which has seven recesses 361 for supporting seven lenses and FIG. 3B shows a side elevation view of that support 360. Any configuration of recesses 361 is possible, although as shown in this embodiment there is a single central recess 361 surrounded by six peripheral recesses 361. Additional structural support members 363 are provided between each peripheral recess 361 and the central recess 361. According to design preference or if desired for certain applications, it is equally possible to have structural support members 363 between some or all of the peripheral recesses 361 in addition to or instead of the support members 363 shown.

Additionally, support 360 could have an overall circular configuration rather than the scalloped edge as shown. For example, a scalloped edge may be preferable where a housing cover is attached to the housing by way of screws through the face plate into the housing of housing components, such as the PCB. If the edge of support 360 is configured to avoid the screws, there is no need to line up holes in support 360 with holes in the face plate when securing with screws. A scalloped edge on support 360 thus in this way can also contribute to ease of manufacturing. FIG. 3B shows a side elevation view of support 360 with seven recesses 361 and structural supports 363 between the peripheral recesses and central recess 361. The lens support 360 could typically be used in MR-16, PAR-16, and PAR-20 type bulbs.

Figure 4A:
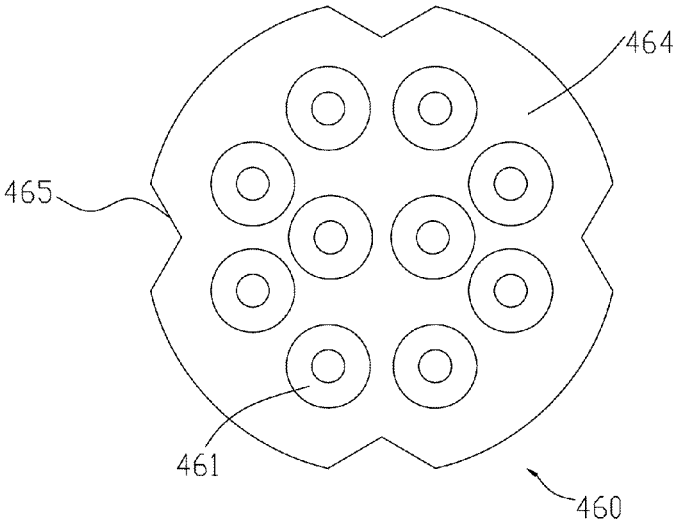
FIGS. 4A-B show top plan and side elevation views of an exemplary lens support according to embodiments of the invention having ten recesses for supporting ten lenses.
Figure 4B:
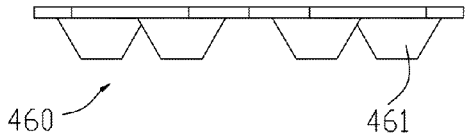

FIGS. 4A-B show top plan and side elevation views of an exemplary lens support 460 according to embodiments of the invention having ten recesses 461 for supporting ten lenses. Again, any configuration of the ten recesses 461 is possible and structural supports 463 can be added or omitted between any of the recesses 461. In this embodiment, no structural support members are shown. The top surface 464 of support 460, as shown in this embodiment, can be shaped (e.g., scalloped or otherwise) to comprise cut outs 465 for accommodating by not interfering with screws for securing the cover plate to the housing of the bulb. Alternatively, or in addition, screw holes can be provided in the top surface 464 of support 460, if desired.

The lens support 460 shown in FIGS. 4A-B could be used to support lenses in a PAR 38 type bulb. To manufacture a PAR 38 type bulb, a manufacturer typically holds all ten lenses or reflectors in place over or in the appropriate vicinity of their corresponding light source at the same time or balances the lenses in position with a very steady hand while installing the cover plate to permanently secure the lenses and other interior lighting components within the housing. The present invention alleviates this manufacturing difficulty by providing a support 460 that enables the simultaneous placement of the lenses within the housing.

Figure 5A:
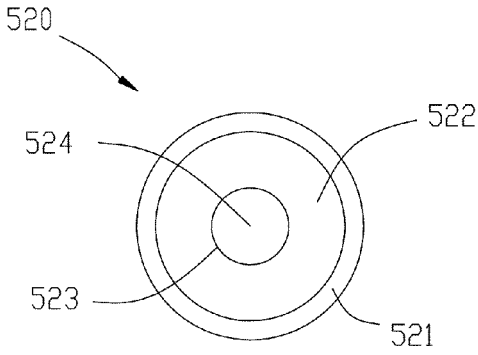
FIGS. 5A-D show respectively a top plan, a bottom plan, a side elevation, and a side elevation cross-section view of an exemplary lens embodiment according to the invention, which is compatible with lens supports shown in FIGS. 2-4.

FIGS. 5A-D show a top plan view, a bottom plan view, a side elevation view, and a cross-sectional view of the side elevation view of an exemplary lens embodiment according to the invention. As shown in FIG. 5A, a lens 520 is provided that is compatible for use with any lens support described in this application, including in particular the lens supports shown in and discussed with respect to the embodiments of FIGS. 2-4. As shown in FIG. 5A, a top plan view of lens 520, there is provided an optional rim 521. Rim 521 provides means for supporting lens 520 in a lens support, provides means for handling the lens 520 during manufacturing to minimize damage to or dirtying of the upper lens surface 522, as well as provides a surface for facilitating insertion and withdrawal of lens 520 into and out of the lens support while minimizing disruption of other installed lenses and/or avoiding inversion of the housing or support during manufacturing in the situation where a lens needs to be removed. Also shown is an outline 523 of the uppermost portion of a lens recess 524 of lens 520 into which a light source projects its light for transmission through the lens 520 during use. As used throughout this application, orientation of components are described with respect to the lamp housing standing in a perpendicular orientation with the cover plate on top.

Figure 5B:
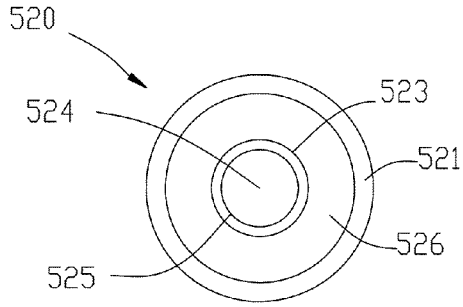

FIG. 5B shows a bottom plan view of lens 520. As shown, rim 521 circumscribes the conical shaped lens 520 at or near the lens surface (not shown). An outline 523 shows the uppermost boundary of lens recess 524 within the lens 520. The lowermost portion of lens recess 524 is defined by outline 525. Surface 526 is a side surface of lens 520, which in this embodiment is conical and extends from the uppermost portion 523 of lens recess 524 to the bottommost portion of rim 521. In this embodiment, surface 526 is conical and complementary to and thus would be compatible with any lens support shown in FIGS. 2-4. Exterior surface 526 of lens 520 is slideably and removeably engageable with the interior surface of the conical and complementary recess of the lens supports shown in FIGS. 2-4. Likewise, rim 521, when assembled with a lens support, can contact the upper surface of the lens support to provide further stability for the lens. In this embodiment, the exterior surface 526 and the bottom surface of rim 521 of lens 520 are said to match rspectively the interior surface of the lens support recess and the upper surface of the lens support. In preferred embodiments, exterior surface 526 of lens 520 is shaped to render the lens capable of contacting or resting on a corresponding surface of a lens support. The entire surface 526 need not contact the corresponding surface of the support completely and/or exactly, so long as sufficient support is provided to enable proper positioning of the lenses within the housing.

Figure 5C:
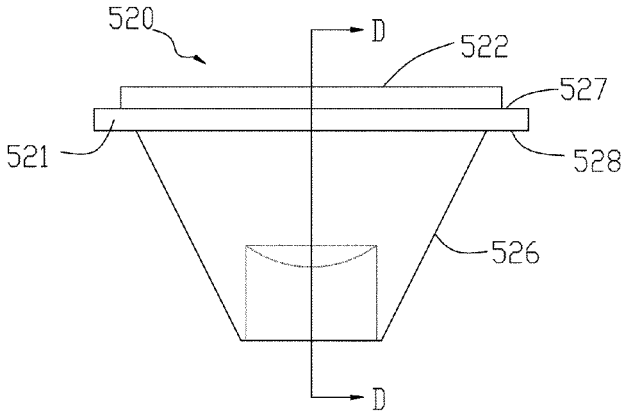

FIG. 5C shows a side elevation view of lens 520. In particular, as shown in this embodiment, lens 520 can be generally conical in shape as defined by outer surface 526. One configuration for rim 521 is also shown, wherein rim 521 circumscribes lens 520 near the top face or upper lens surface 522. The rim 521 comprises an upper rim surface 527 and a lower rim surface 528. Accordingly, the rim surfaces 527 and 528 can be desirable for containing the lens within the lamp housing. In embodiments, a cover plate can be installed on the lamp housing to contain the lenses 520 within the housing by contacting or otherwise being operably connected with upper rim surface 527 to prevent the lens 520 from escaping the housing once installed with the cover plate in place. Additionally lower rim surface 528 can be used the further support lens 520 within the lens support by contacting lower rim surface 528 with a surface of the lens support, usually the upper lens support surface. In the context of this application, surfaces 526 and 528 are said to form the lower exterior surface of lens 520. There may be an additional portion of the lower exterior surface of the lens, however, whether this additional surface, typically at the base of the lens, interacts with the lens support is inconsequential.

Figure 5D:
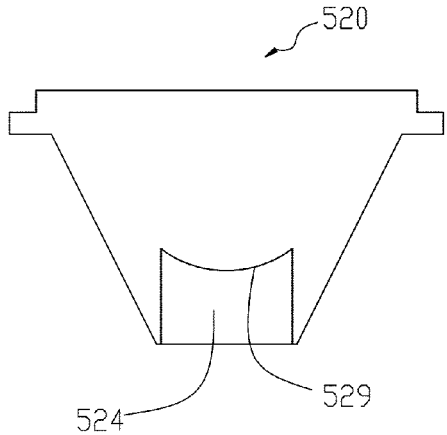

FIG. 5D shows a cross-section of the side elevation view of lens 520 provided in FIG. 5C. Recess 524 can be of any size and shape desired, so long as the recess 524 is capable of accommodating the light source for the lamp assembly. Within recess 524 is surface 529 shaped for directing, projecting, or otherwise controlling or manipulating light emitted from a light source of the lamp assembly during use. In this embodiment, light controlling surface 529 is of a generally convex shape toward the light source. Surface 529 can also be concave or planar or of any appropriate shape for controlling the light emitted from the light source.

Figure 6A:
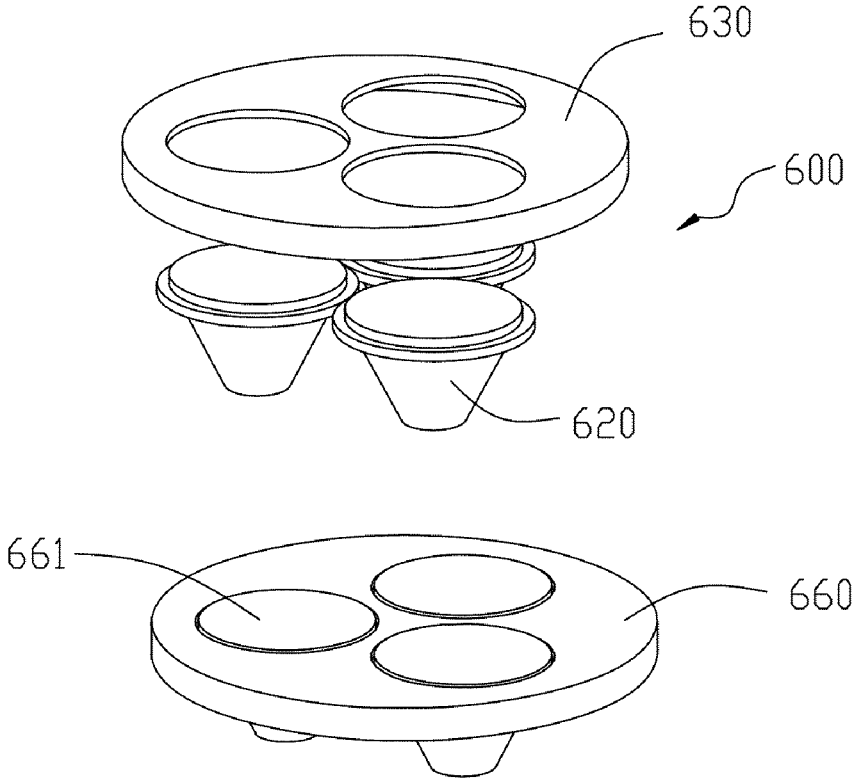
FIGS. 6A-D show unassembled and assembled an exemplary embodiment of a lens support, compatible lenses, and a housing cover for a PAR-16, MR-16, or PAR-20 type bulb having three LEDs.
Figure 6B:
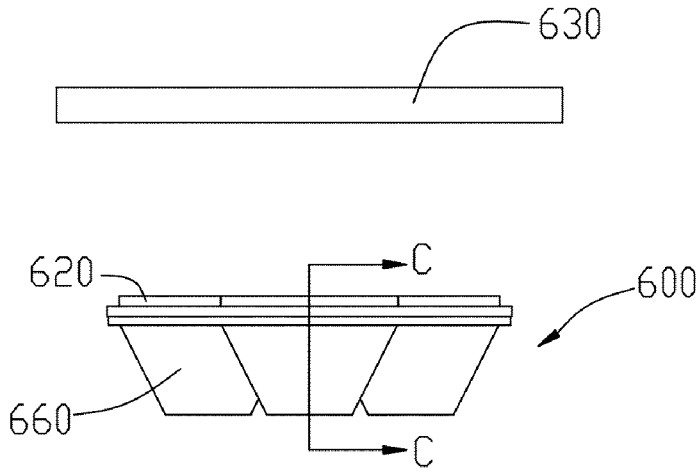
Figure 6C:
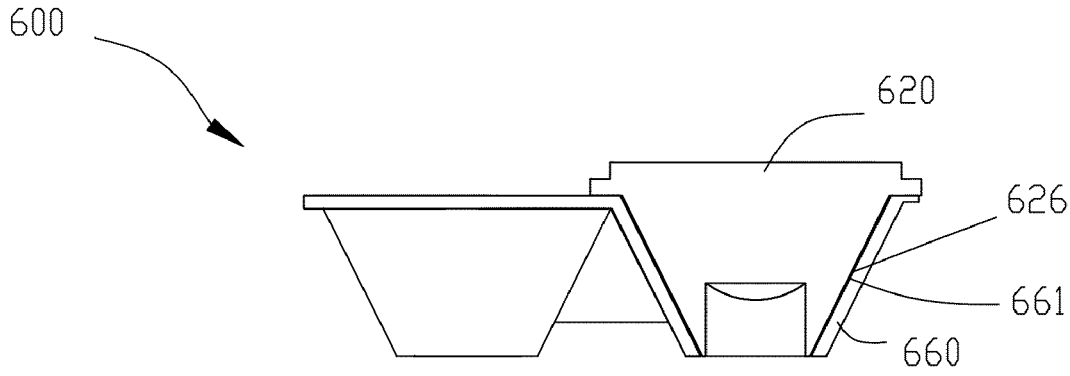
Figure 6D:
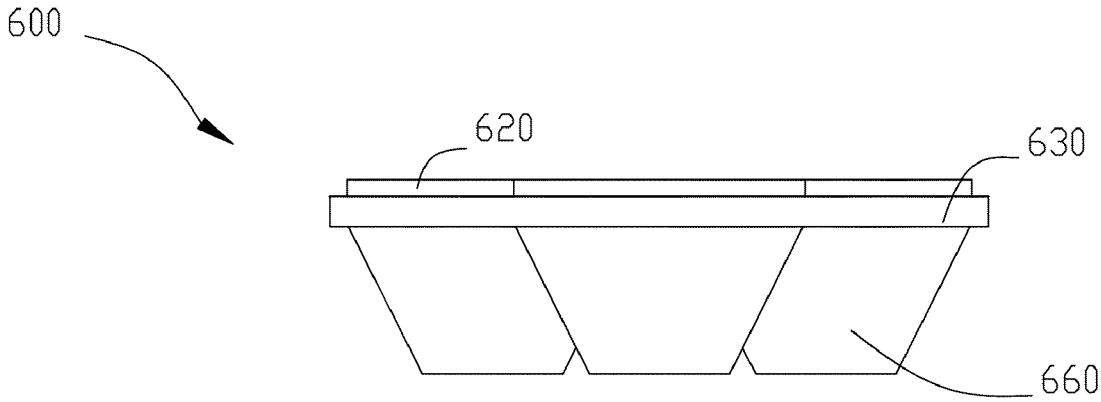

FIGS. 6A-D show unassembled and assembled an exemplary embodiment of a light assembly 600 comprising a lens support, compatible lenses, and a housing cover plate for a PAR-16, MR-16, or PAR-20 type bulb having three LEDs. FIG. 6A provides an unassembled view of a lens support 660 comprising three recesses 661, three complementary lenses 620, and a cover plate 630 for securing the components within the lamp housing when assembled. FIG. 6B provides a partial assembly view of the components, including a view of lens support 660 assembled with lenses 620 and the cover plate 630 unassembled. A cross-sectional view of FIG. 6B is provided in FIG. 6C. Of particular interest in this view (taken along line C-C of FIG. 6B) are the complementary shapes of outer surface 626 of lens 620 and inner surface 661 of lens support 660 as well as the complementary surface of the lower surface of the lens 620 rim which contacts the upper surface of lens support 660. As shown, these surfaces can be of corresponding shape, here both the exterior 626 surface of the lens and the interior 661 surface of the lens recess of support 660 are conical, to provide for maintaining a position of lens 620 within the lamp assembly housing once installed. Similarly, the bottom surface of lens 620 rim can be shaped to contact the upper surface of lens support 660 also as shown. For purposes of this application, maintaining refers to keeping the lenses 620 in a desired position, which may mean for temporarily or permanently fixing the lens within the support or also allowing for some variation of position when installed in the housing without adversely affecting operation of the device. Once installed, the lens 620 need not be in a concrete, fixed position within the housing and some movement of the components is possible, and may even be desirable in certain embodiments. It may even be desirable to fix the lenses 620, once properly positioned, to prevent rearrangement of the components during use. Many possibilities exist for complementary surfaces 626, 661 and this embodiment shows complementary conical shapes, which is just one example. Similarly, many embodiments exist for shapes of the lower surface of the lens rim and the upper surface of the lens support. Especially preferred are embodiments wherein when assembled the lens(es) are seated within the lens support (reflector) totally (meaning the side surface of the lens 626 fits completely within the recess of the lens support) to provide for better positioning of the lenses with respect to the light sources. Even further preferred are such embodiments wherein the side surface 626 of the lens is complementary to and matches the inner surface 661 of the lens support recess, to provide for more exact positioning of the lens within the housing. FIG. 6D shows lens support 660 assembled with lenses 620 and cover plate 630 installed. In this embodiment, the top surface 622 of lens 620 is shown protruding through through-hole 631 of cover plate 630. In this manner, cover plate 630 secures lenses 620 in place within the lamp housing by opposing the rim (not shown in this view) of the lenses 620. When installed in the lamp housing, the top surface 622 of lens 620 can be positioned at or about the same plane as cover plate 630. Other ways of securing the lenses within the housing exist, such as by constructing the upper surface of the lens with or without a rim to be larger in diameter than a hole in the cover plate through which the light will pass during use.

Figure 7A:
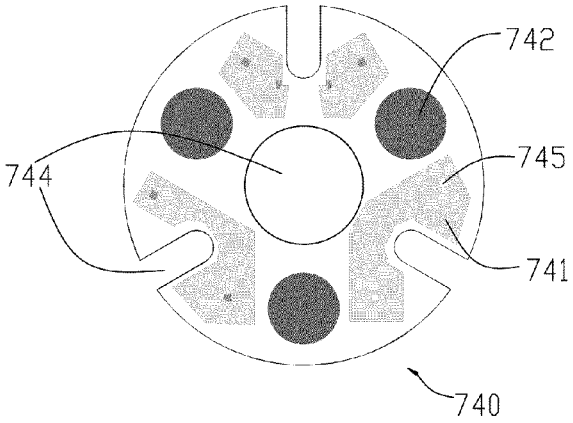
FIGS. 7A-D show schematic examples of PCBs for PAR-16, MR-16, PAR-20, PAR-30, and PAR-38 bulbs according to embodiments of the invention.
Figure 7B:
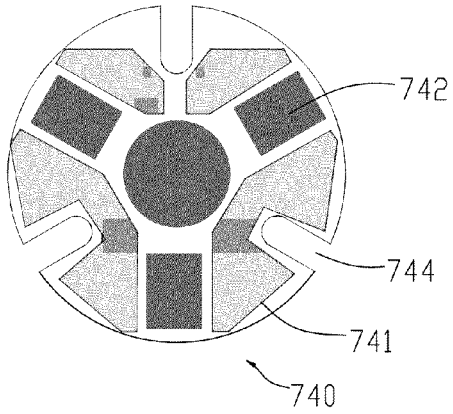
Figure 7C:
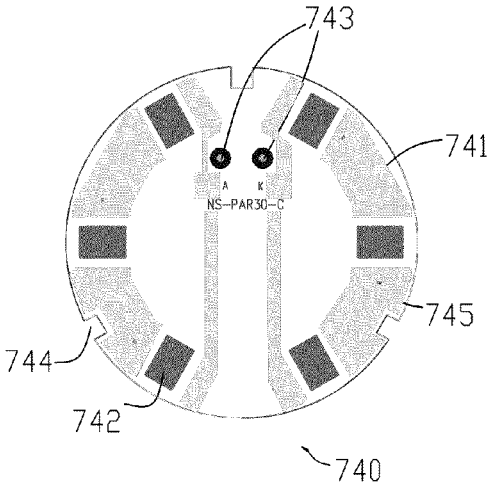
Figure 7D:
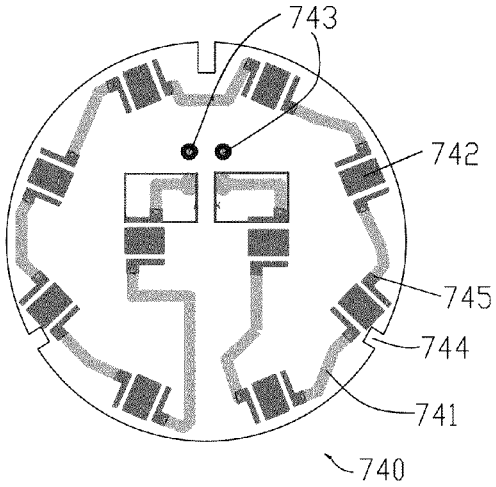
Figure 8:
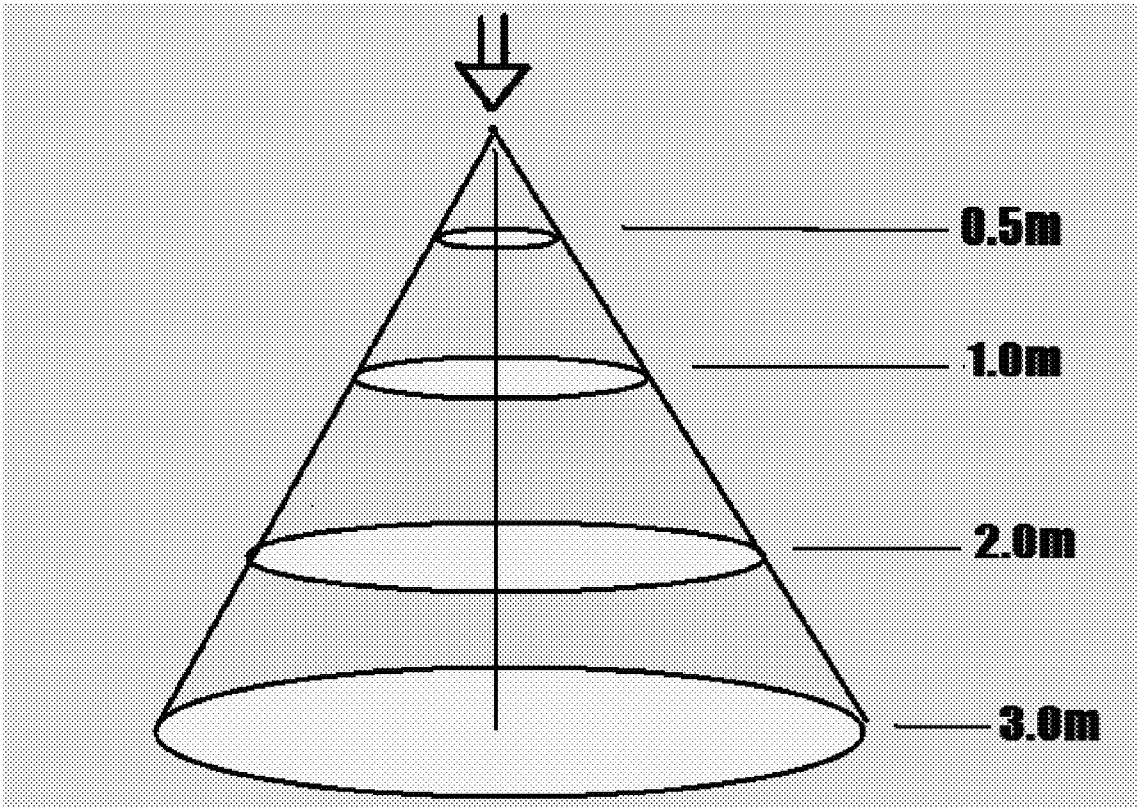
FIG. 8 provides a schematic representation of light measurements taken to compile the brightness measurement data of Table 3 for various types of bulbs according to the invention.

FIGS. 7A-D show various examples of PCBs for PAR-16, MR-16, PAR-20, PAR-30, and PAR-38 bulbs according to embodiments of the invention. FIG. 7A shows an example of a PCB 740 that can be used for an MR-16 or PAR-16 type bulb having three light sources. FIG. 7B shows an exemplary PCB 740 for a PAR-20 type lamp with three light sources. FIG. 7C shows an example of a PCB 740 for a PAR-30 type lamp with seven light sources. FIG. 7D shows an example of a PCB that can be used for a PAR-38 type lamp with ten light sources. Applicable to FIGS. 7A-D, the pathway of electrical circuit 741 is completed when the light sources are mounted where indicated at 742. The light sources can be secured at 742 and operably connected to the electrical circuit 741 by way of soldering electrical contacts of the light sources to the electrical circuit 741 at for example where indicated at 745. Wire leads, or other structure operably connecting electrical pathways 741 and the light sources to a power source to complete the circuit, can be operably connected where indicated at 743. Various strategically placed cut-outs or notches 744 can be provided for providing a means to engage with corresponding structure (e.g., posts) in the lamp housing to deter or prevent the PCB 740 from moving within the housing once positioned in a desired manner within the lamp assembly housing. Further, for example, such cut-outs 744 can allow for wire leads or other components within the lamp housing to pass through from below the PCB 740 to be operably connected to the upper surface of PCB 740.

The brightness characteristics of lamp assemblies according to embodiments of the invention include those specified in Table 3. Brightness measurements were taken at various distances of which a schematic representation of the illumination and distances measured is provided in FIG. 8. The characteristics described are reflective of bulbs using VaOpto LEDs and may be different when other LEDs from other manufacturers are used.

TABLE 3

MR-16, PAR-16, 20, 30, 38 Brightness Characteristics

| TYPE | at 0.5 M | at 1 M | at 2 M | at 3 M |
|---|---|---|---|---|
| MR-16 | | | | |
| | ILLUMINANCE (CENTER) IN LUX | | | |
| VO-MR16-1WW3-130-53V30 | 1000 | 300 | 80 | 30 |
| VO-MR16-1NW3-150-53V30 | 1200 | 400 | 100 | 40 |
| VO-MR16-1CW3-180-53V30 | 1400 | 500 | 120 | 50 |
| PAR-16 | | | | |
| | ILLUMINANCE (CENTER) | | | |
| VO-PAR16-1WW3-180-30-120 | 2500 | 750 | 200 | 80 |
| VO-PAR16-1NW3-240-30-120 | 3500 | 1000 | 250 | 100 |
| VO-PAR16-1CW3-300-30-120 | 6000 | 2000 | 500 | 200 |

TABLE 3-continued

| MR-16, PAR-16, 20, 30, 38 Brightness Characteristics | | | | |
|---|---|---|---|---|
| TYPE | at 0.5 M | at 1 M | at 2 M | at 3 M |
| PAR-20 | | | | |
| VO-PAR20-2WW3-240-30-120 (277) | 3600 | 1100 | 270 | 110 |
| VO-PAR20-2NW3-320-30-120 (277) | 4500 | 1300 | 330 | 150 |
| VO-PAR20-2CW3-400-30-120 (277) | 8000 | 2600 | 650 | 250 |
| PAR-30 | | | | |
| VO-PAR30-1WW7-450-30-120 (277) | 7000 | 1950 | 500 | 220 |
| VO-PAR30-1NW7-550-30-120 (277) | 9000 | 2600 | 700 | 350 |
| VO-PAR30-1CW7-700-30-120 (277) | 1100 | 3300 | 900 | 450 |
| PAR-38 | | | | |
| VO-PAR38-2WW10-900-30-120 (277) | 13600 | 3600 | 960 | 440 |
| VO-PAR38-2NW10-1100-30-120 (277) | 17200 | 4400 | 1280 | 560 |
| VO-PAR38-2CW10-1300-30-120 (277) | 19600 | 4960 | 1440 | 720 |

Figure 9A:
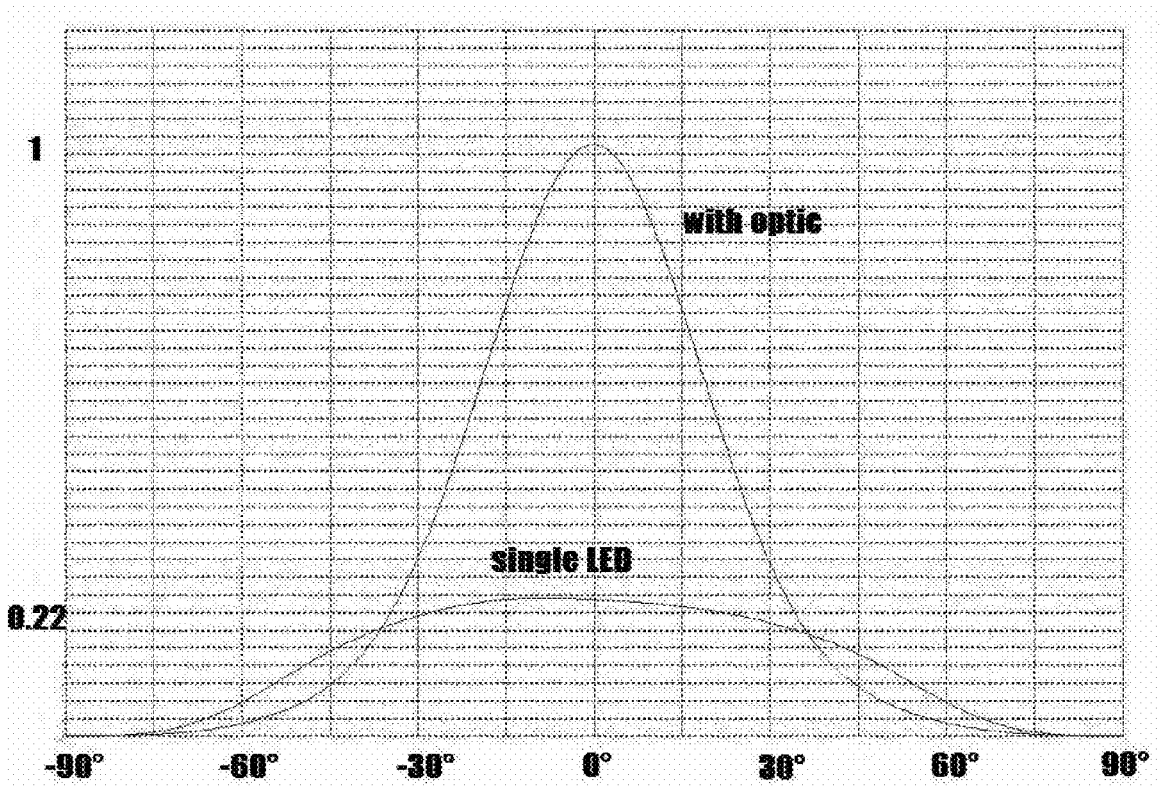
FIG. 9A provides a graph of the viewing angles for an exemplary MR-16 type light bulb according to the invention with and without optical enhancement of the LED with a lens.
Figure 9B:
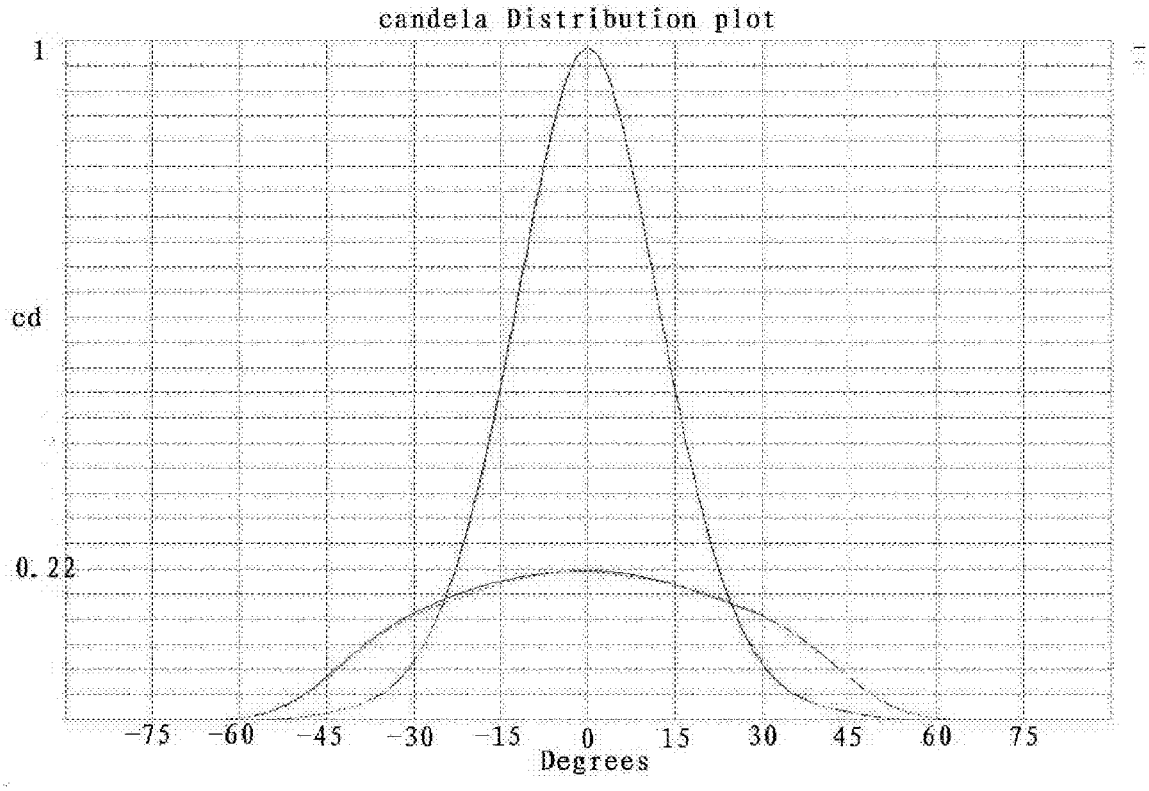
FIG. 9B provides a graph of the viewing angles for PAR-16, 20, 30, and 38 type light bulbs according to the invention with and without optical enhancement of the LED with a lens.
Figure 10:
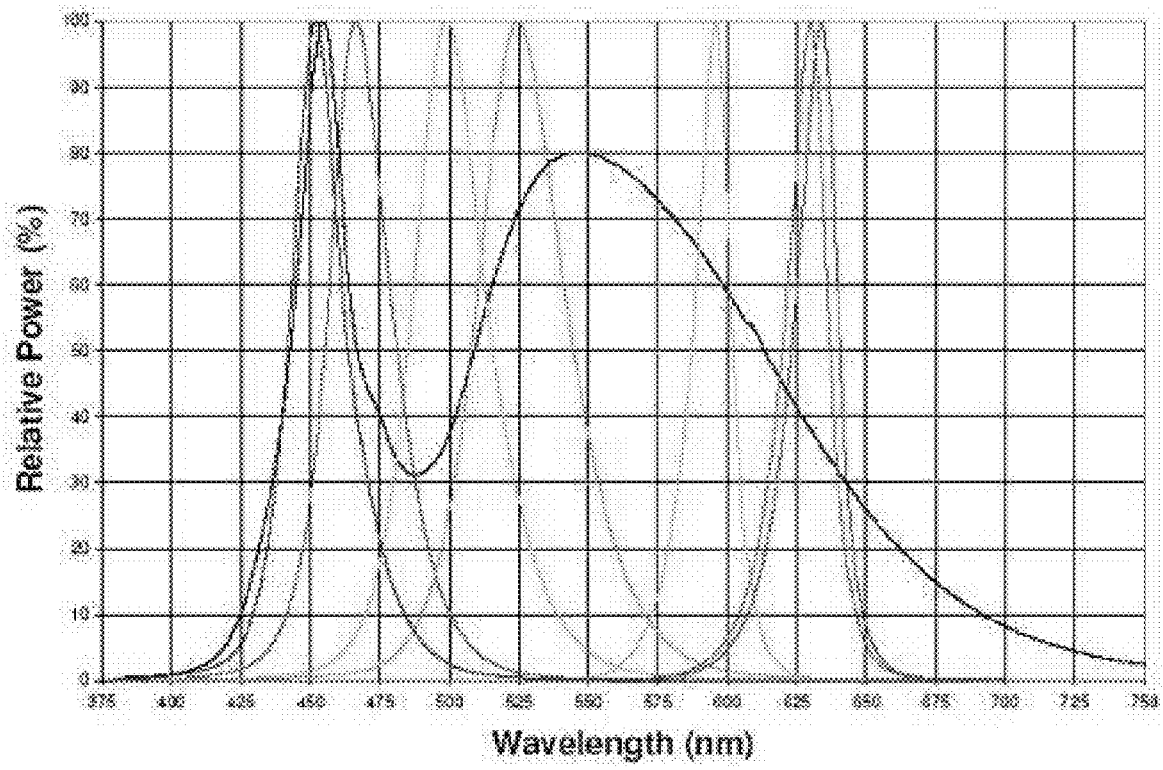
FIG. 10 provides a graph of brightness characteristics of exemplary bulbs in accordance with embodiments of the invention.

The viewing angles of lamp assemblies according to embodiments of the invention include those specified in FIGS. 9A and 9B. FIG. 9A provides a graph of the viewing angles for an MR-16 type bulb according to the invention with and without optical enhancement of the LED with a lens. Similarly, FIG. 9B provides a graph of the viewing angles for PAR-16, 20, 30, and 38 type bulbs according to the invention with and without optical enhancement of the LED with a lens.

Additional brightness characteristics are provided below in Table 4 for exemplary MR-16, PAR-16, PAR-20, PAR-30, and PAR-38 type spot light bulbs in accordance with the invention. The wavelength characteristics are also provided in graphical form in FIG. 10. The characteristics described in Table 4 are reflective of bulbs using VaOpto LEDs and may be different when other LEDs from other manufacturers are used.

TABLE 4

| MR-16, PAR-16, 20, 30, 38 Brightness Characteristics | | | | |
|---|---|---|---|---|
| | | Dominant wavelength (nm) or CCT (K) | | Typical |
| TYPE | Color | Min. | Max. | Luminous |
| MR-16 | | | | |
| VO-MR16-1R3V-30G53A-12N | Red | 620 nm | 630 nm | 150 lm |
| VO-MR16-1Y3V-30G53A-12N | Amber | 585 nm | 595 nm | 150 lm |
| VO-MR16-1G3V-30G53A-12N | Green | 520 nm | 535 nm | 180 lm |
| VO-MR16-1B3V-30G53A-12N | Blue | 465 nm | 475 nm | 60 lm |
| VO-MR16-1CW3V-30G53A-12N | Cool White | 5000 K | 10000 K | 210 lm |
| VO-MR16-1NW3V-30G53A-12N | Neutral White | 3700 K | 5000 K | 195 lm |
| VO-MR16-1WW3V-30G53A-12N | Warm White | 2600 K | 3700 K | 180 lm |
| PAR-16 | | | | |
| VO-PAR16-1R3V-30E26B-120N | Red | 620 nm | 630 nm | 150 lm |
| VO-PAR16-1Y3V-30E26B-120N | Amber | 585 nm | 595 nm | 150 lm |
| VO-PAR16-1G3V-30E26B-120N | Green | 520 nm | 535 nm | 180 lm |
| VO-PAR16-1B3V-30E26B-120N | Blue | 465 nm | 475 nm | 60 lm |
| VO-PAR16-1CW3V-30E26B-120N | Cool White | 5000 K | 10000 K | 210 lm |
| VO-PAR16-1NW3V-30E26B-120N | Neutral White | 3700 K | 5000 K | 195 lm |
| VO-PAR16-1WW3V-30E26B-120N | Warm White | 2600 K | 3700 K | 180 lm |
| PAR-20 | | | | |
| VO-PAR20-2R3V-30E26B-120N | Red | 620 nm | 630 nm | 200 lm |
| VO-PAR20-2Y3V-30E26B-120N | Amber | 585 nm | 595 nm | 200 lm |
| VO-PAR20-2G3V-30E26B-120N | Green | 520 nm | 535 nm | 230 lm |
| VO-PAR20-2B3V-30E26B-120N | Blue | 465 nm | 475 nm | 80 lm |
| VO-PAR20-2CWV-30E26B-120N | Cool White | 5000 K | 10000 K | 270 lm |
| VO-PAR20-2NW3V-30E26B-120N | Neutral White | 3700 K | 5000 K | 250 lm |
| VO-PAR20-2WW3V-30E26B-120N | Warm White | 2600 K | 3700 K | 230 lm |
| PAR-30 | | | | |
| VO-PAR30-1R7V-30E26B-120N | Red | 620 nm | 630 nm | 310 lm |
| VO-PAR30-1Y7V-30E26B-120N | Amber | 585 nm | 595 nm | 310 lm |
| VO-PAR30-1G7V-30E26B-120N | Green | 520 nm | 535 nm | 390 lm |
| VO-PAR30-1B7V-30E26B-120N | Blue | 465 nm | 475 nm | 110 lm |
| VO-PAR30-1CW7V-30E26B-120N | Cool White | 5000 K | 10000 K | 490 lm |
| VO-PAR30-1NW7V-30E26B-120N | Neutral White | 3700 K | 5000 K | 455 lm |
| VO-PAR30-1WW7V-30E26B-120N | Warm White | 2600 K | 3700 K | 420 lm |
| PAR-38 | | | | |
| VO-PAR38-2R10V-30E26B-120N | Red | 620 nm | 630 nm | 310 lm |
| VO-PAR38-2Y10V-30E26B-120N | Amber | 585 nm | 595 nm | 310 lm |
| VO-PAR38-2G10V-30E26B-120N | Green | 520 nm | 535 nm | 390 lm |
| VO-PAR38-2B10V-30E26B-120N | Blue | 465 nm | 475 nm | 110 lm |
| VO-PAR38-2CW10V-30E26B-120N | Cool White | 5000 K | 10000 K | 490 lm |
| VO-PAR38-2NW10V-30E26B-120N | Neutral White | 3700 K | 5000 K | 455 lm |
| VO-PAR38-2WW10V-30E26B-120N | Warm White | 2600 K | 3700 K | 420 lm |

Figure 11A:
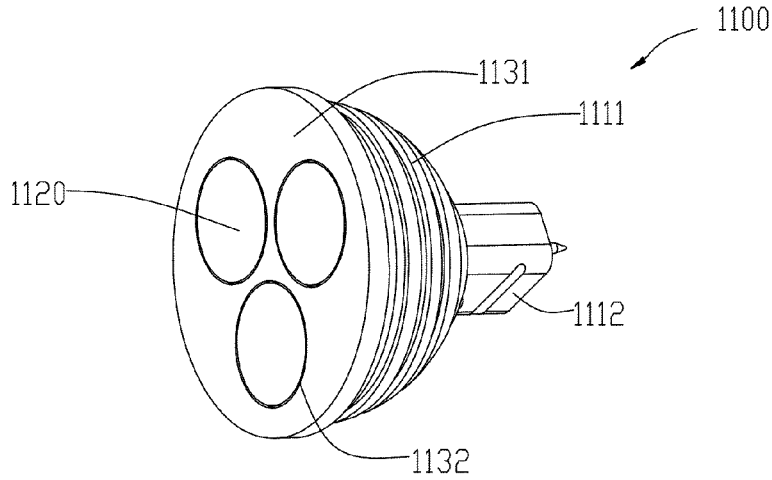
FIGS. 11A-C show various views of an exemplary spot light type bulb according to embodiments of the invention.
Figure 11B:
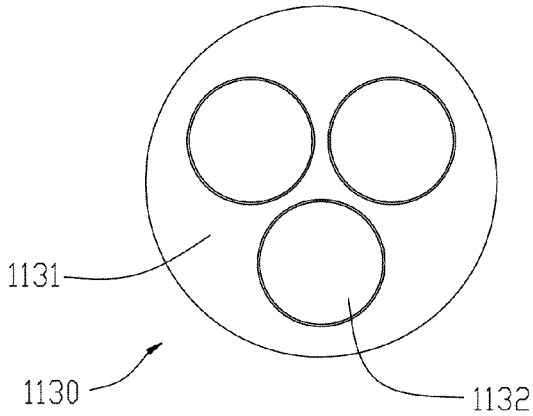
Figure 11C:
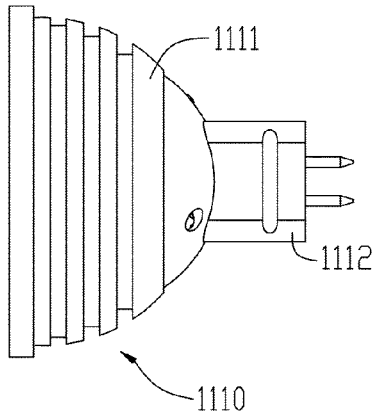

FIGS. 11A-C provide various views of an exemplary spot light bulb according to embodiments of the invention. As shown, this MR-16 type bulb 1100 can be provided in 12V AC/DC input, having red, amber, green, blue, or white color LEDs. This bulb 1100 shows lenses 1120 secured by cover plate 1130 in the lamp housing 1110, through which the lenses 1120 protrude by way of holes 1132 through the top surface or face 1131 of cover plate 1130. The lamp housing 1110 comprises heat sink 1111, cover plate 1130, and base 1112, in addition to other components or features not shown or highlighted herein. Of particular interest in this embodiment is the configuration of heat sink 1111, which provides for dissipation of heat by way of the circumferentially arranged protrusions and depressions in the housing surface. The heat sink 1111 can comprise ceramic, plastic, metal, combinations and composites thereof, as well as heat pipe technology. The preferred heat sinks 1111 comprise the materials discussed earlier in this application and are preferred for and applicable to all embodiments of the invention. The base 1112 shown is a standard 2-pin GU5.3 base, which can be used for any embodiment of the invention.

Figure 12A:
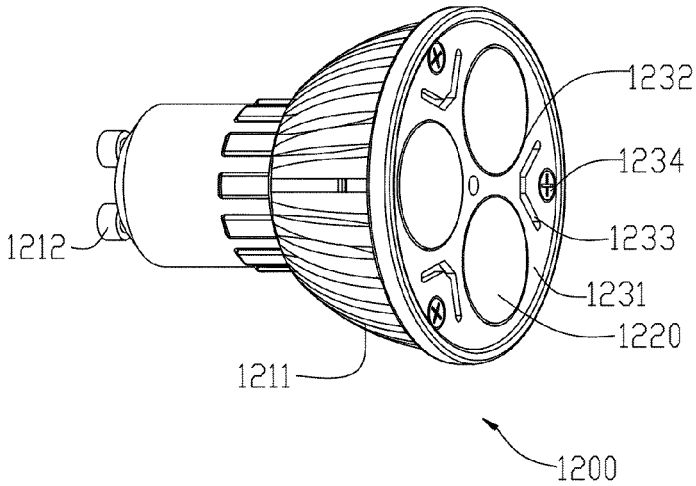
FIGS. 12A-C show various views of an exemplary spot light type bulb according to embodiments of the invention.
Figure 12B:
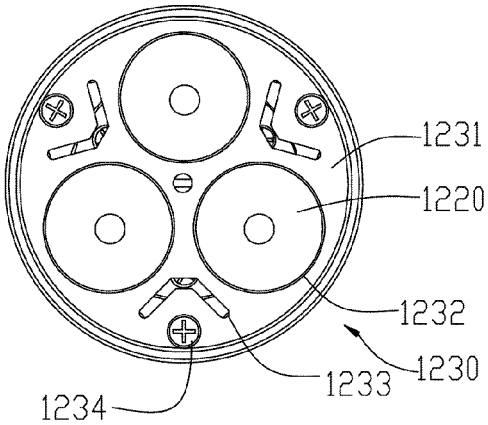
Figure 12C:
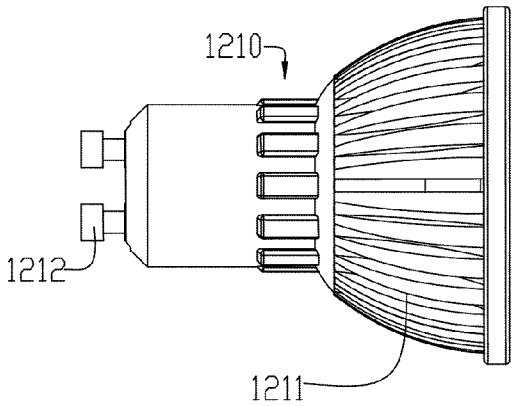

FIGS. 12A-C provide various views of an exemplary spot light bulb according to embodiments of the invention. As shown, this MR-16 type bulb 1200 can be provided with 85-260V AC input, having red, amber, green, blue, or white color LEDs. This bulb 1200 shows lenses 1220 secured by cover plate 1230 in the lamp housing 1210, through which the lenses 1220 protrude by way of holes 1232 through the top surface or face 1231 of cover plate 1230. The cover plate 1230 is secured to the housing by way of screws 1234 and can comprise vents 1233 as shown. The lamp housing 1210 comprises heat sink 1211, cover plate 1230, and base 1212, in addition to other components or features not shown or highlighted herein. Of particular interest in this embodiment is the configuration of heat sink 1211, which provides for dissipation of heat by way of longitudinally arranged protrusions and depressions in the housing surface. The heat sink 1211 can comprise ceramic, plastic, metal, combinations and composites thereof, as well as heat pipe technology. The preferred heat sinks 1211 comprise the materials discussed earlier in this application and are preferred for and applicable to all embodiments of the invention. The base 1212 shown is a standard 2-pin GU10 base, which can be used for any embodiment of the invention.

Figure 13:
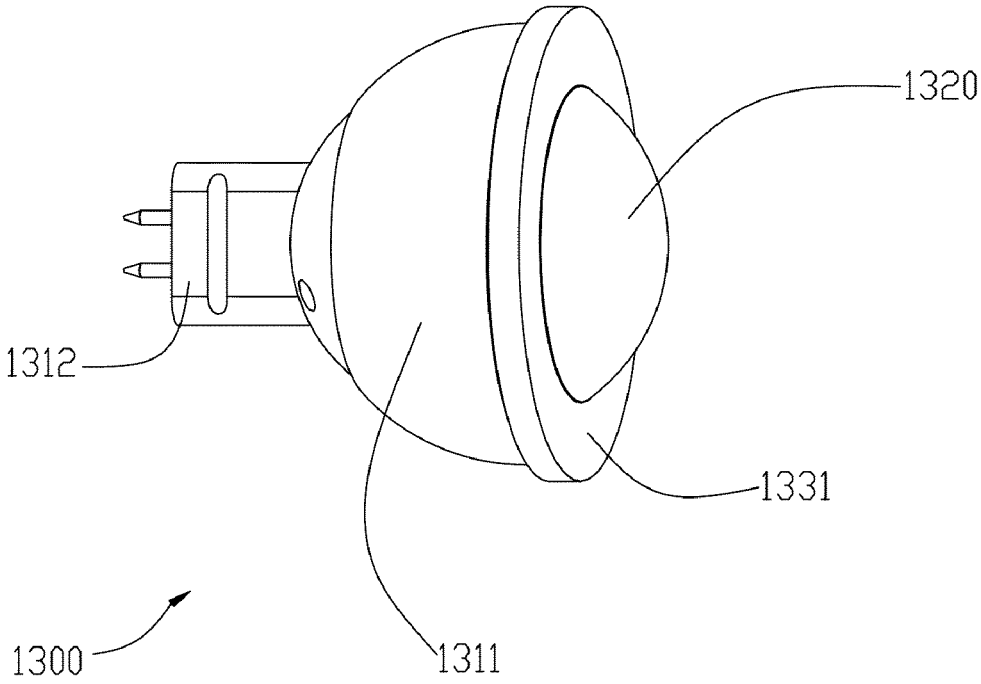
FIG. 13 provides another example of a spot light type lighting device according to embodiments of the invention.

FIG. 13 provides another example of an MR-16 type bulb according to the invention. In particular, as shown, this MR-16 type bulb 1300 can be provided with 12V AC/DC input, having red, yellow, green, blue, or white color (including cool, neutral, or warm white) LEDs. This bulb 1300 shows a single lens 1320 protruding through the cover plate of the housing and significantly above the cover plate surface 1331. The cover plate can be secured to the housing by way of screws, pressure fit, adhesive, or other male/female type connectors. The heat sink 1311 provides for another configuration of the heat sink with a solid and continuous surface, which can comprise ceramic, plastic, metal, combinations and composites thereof, as well as heat pipe technology. The preferred heat sinks 1311 comprise the materials discussed earlier in this application and are preferred for and applicable to all embodiments of the invention. The base 1312 shown is a standard 2-pin GU5.3 base, which can be used for any embodiment of the invention.

Figure 14:
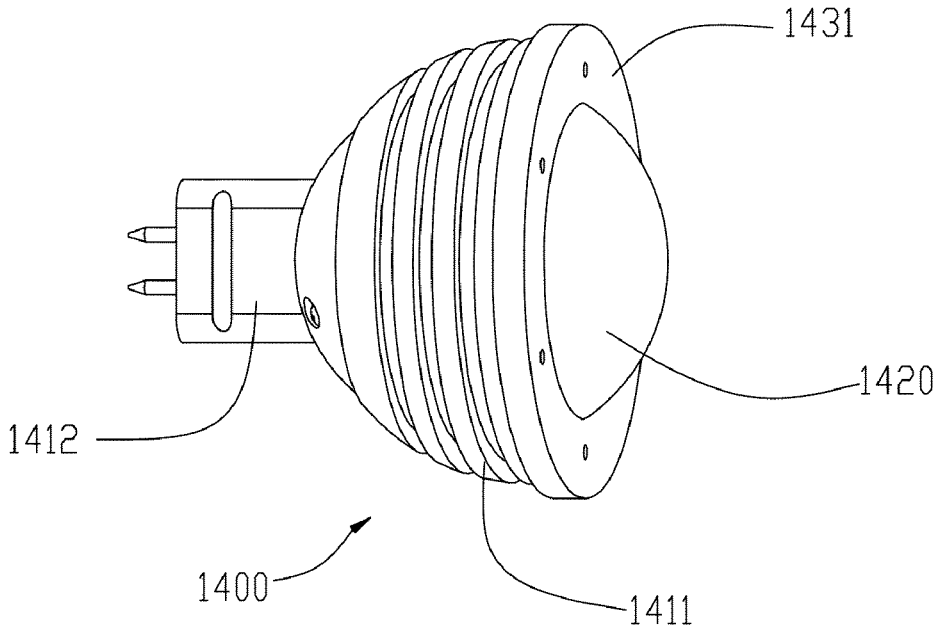
FIG. 14 is another embodiment of the invention.

FIG. 14 provides another example of an MR-16 type bulb according to the invention. In particular, as shown, this MR-16 type bulb 1400 can be provided with 12V AC/DC input, having red, yellow, green, blue, or white color (including cool, neutral, or warm white) LEDs. This bulb 1400 shows a single lens 1420 protruding through the cover plate of the housing and significantly above the cover plate surface 1431. The cover plate can be secured to the housing by way of screws, pressure fit, adhesive, or other male/female type connectors. The heat sink 1411 provides for a heat dissipating surface arranged laterally or circumferentially around the housing, which can comprise ceramic, plastic, metal, combinations and composites thereof, as well as heat pipe technology. The preferred heat sinks 1411 comprise the materials discussed earlier in this application and are preferred for and applicable to all embodiments of the invention. In particular, the heat sinks of the invention preferably comprise polyamide or polyphenyl sulfide disposed in any combination of ridges and troughs (which together create projections commonly referred to as fins), and vents to provide for a housing having a heat sink surface area that is twice or greater than that of a lamp assembly of the same size without ridges, troughs, or vents. For example, the surface area of heat sink 1411 of FIG. 14 when compared with the heat sink 1311 of the same size lamp assembly in FIG. 13, the ridges and troughs shown in FIG. 14 provide for an increased surface area, which increases the capability of the lamp assembly to dissipate heat. Base 1412 shown is a standard 2-pin GU5.3 base.

Figure 15A:
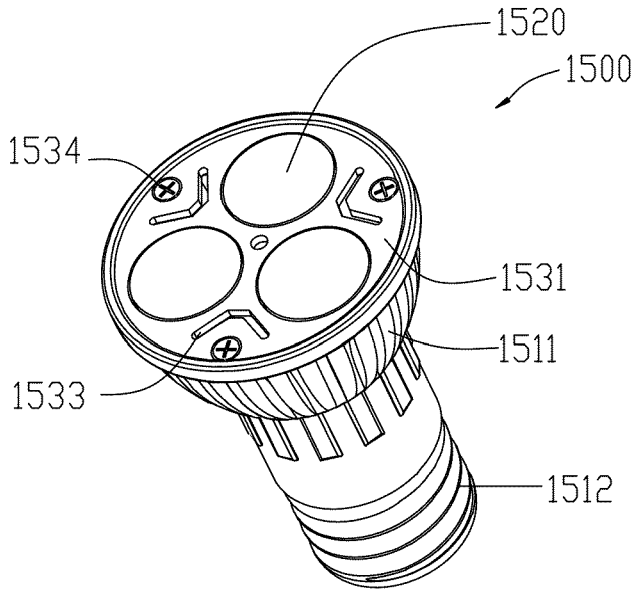
FIGS. 15A-C provide various views of another embodiment of a spotlight type device according to the invention.
Figure 15B:
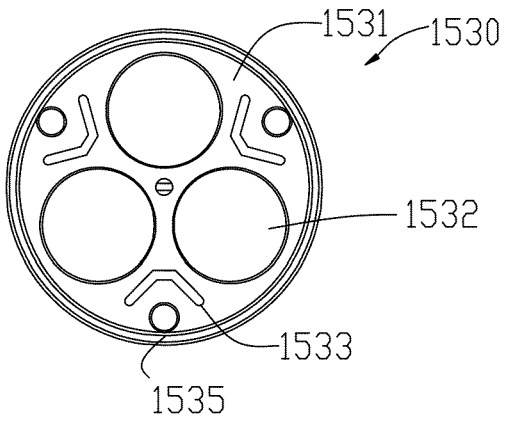
Figure 15C:
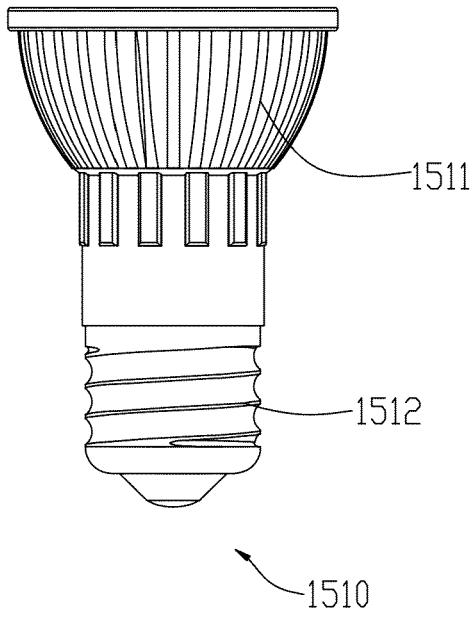

FIGS. 15A-C provide various views of another exemplary spot light bulb according to embodiments of the invention. As shown, this PAR-16 type bulb 1500 can be provided in 85-260V AC/DC input, having red, amber, green, blue, or white color LEDs. This bulb 1500 shows three lenses 1520 secured by cover plate 1530 in the lamp housing 1510, through which the lenses 1520 protrude by way of holes 1532 through the top surface or face 1531 of cover plate 1530. The lamp housing 1510 comprises heat sink 1511, cover plate 1530, and base 1512, in addition to other components or features not shown or highlighted herein. Of particular interest in this embodiment is the configuration of heat sink 1511, which provides for dissipation of heat by way of the longitudinally arranged ridges and valleys in the housing surface. The heat sink 1511 can comprise ceramic, plastic, metal, combinations and composites thereof, as well as heat pipe technology. The preferred heat sinks 1511 comprise the materials discussed earlier in this application and are preferred for and applicable to all embodiments of the invention. The base 1512 shown is a standard E26/E27 base, which can be used for any embodiment of the invention. Vents 1533 can also be provided in the housing, as here the vents are provided in the top surface 1531 of the cover plate. Further, any means can be used for securing the cover plate to the housing, including screws 1534 as shown, which are accommodated by the face plate through holes 1535.

Figure 16A:
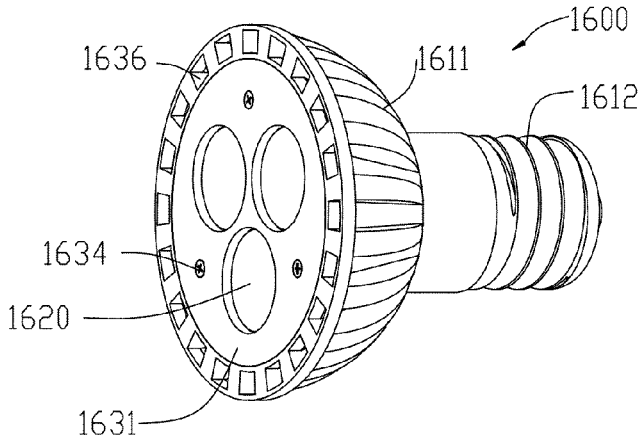
FIGS. 16A-C show several views of an embodiment of the invention.
Figure 16B:
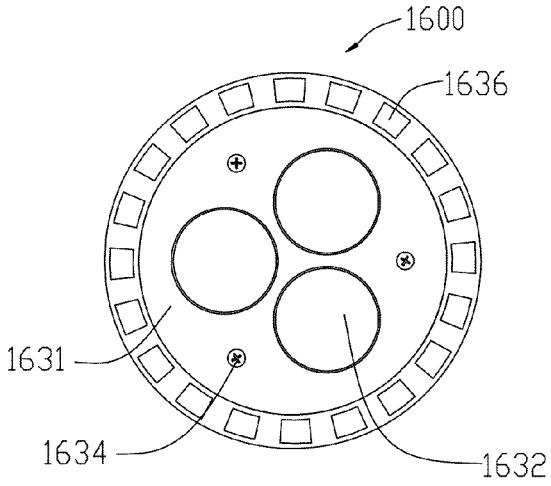
Figure 16C:
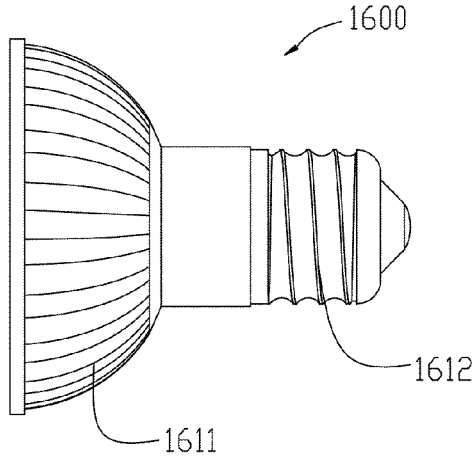

FIGS. 16A-C provide various views of another exemplary spot light bulb according to embodiments of the invention. As shown, this PAR-20 type bulb 1600 can be provided in 85-260V AC input, having red, amber, green, blue, or white color LEDs. This bulb 1600 shows three lenses 1620 secured by the housing cover plate, through which the lenses protrude by way of holes 1632 through the top surface or face 1631. The lamp housing comprises heat sink 1611, cover plate, and base 1612, in addition to other components or features not shown or highlighted herein. Of particular interest in this embodiment is the configuration of heat sink 1611, which provides for dissipation of heat by way of the longitudinally arranged ridges and valleys in the housing surface and cutouts or vents 1636 around the circumference of the lamp. The heat sink 1611 can comprise ceramic, plastic, metal, combinations and composites thereof, as well as heat pipe technology. The preferred heat sinks 1611 comprise the materials discussed earlier in this application and are preferred for and applicable to all embodiments of the invention. The base 1612 shown is a standard E26/E27 base, which can be used for any embodiment of the invention. Any means can be used for securing the cover plate to the housing, including screws 1634 as shown.

Figure 17A:
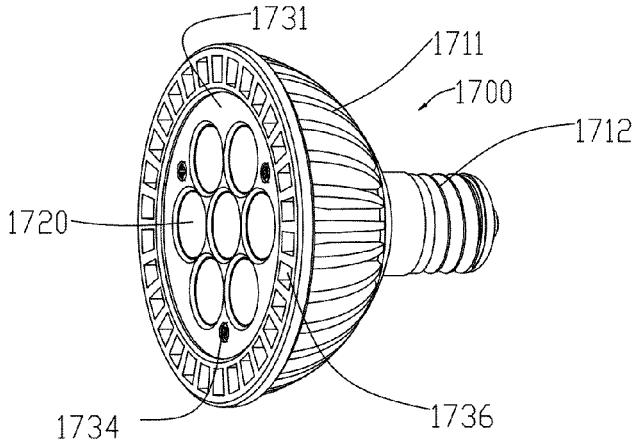
FIGS. 17A-C provide various views of an additional embodiment of an LED lighting device according to the invention.
Figure 17B:
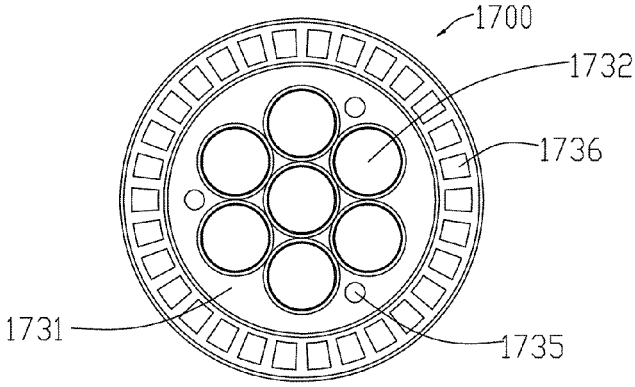
Figure 17C:
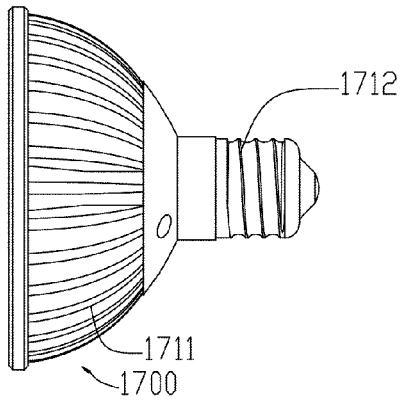

FIGS. 17A-C provide various views of another exemplary spot light bulb according to embodiments of the invention. As shown, this PAR-30 type bulb 1700 can be provided in 85-260V AC/DC input, having red, amber, green, blue, or white color LEDs. This bulb 1700 shows seven lenses 1720 secured by the housing cover plate, through which the lenses protrude by way of holes 1732 through the top surface 1731 of the cover plate. The lamp housing comprises heat sink 1711, cover plate, and base 1712, in addition to other components or features not shown or highlighted herein. Of particular interest in this embodiment is the configuration of heat sink 1711, which provides for dissipation of heat by way of the longitudinally arranged ridges and valleys in the housing surface and cut-outs or vents 1736 around the circumference of the lamp. The heat sink 1711 can comprise ceramic, plastic, metal, combinations and composites thereof, as well as heat pipe technology. The preferred heat sinks 1711 comprise the materials discussed earlier in this application and are preferred for and applicable to all embodiments of the invention. The base 1712 shown is a standard E26/E27 base. Any means can be used for securing the cover plate to the housing, including screws 1734 which are accommodated through holes 1735 in the cover plate.

Figure 18A:
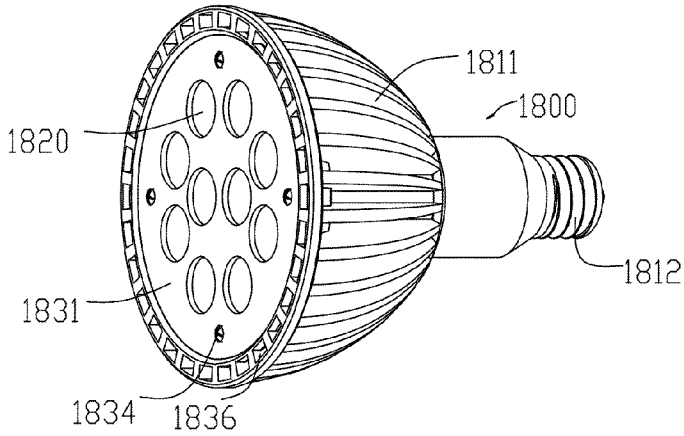
FIGS. 18A-C show various views of a spot light type bulb according to embodiments of the invention.
Figure 18B:
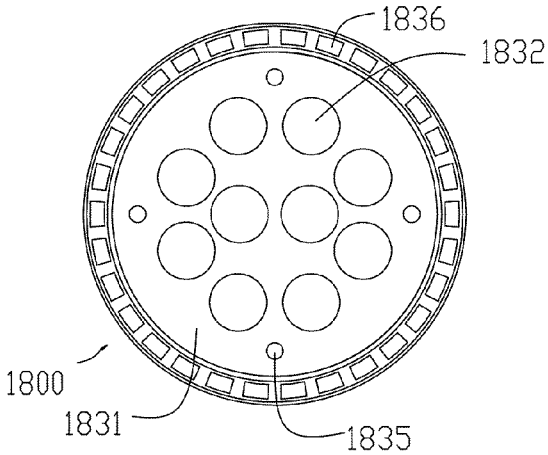
Figure 18C:
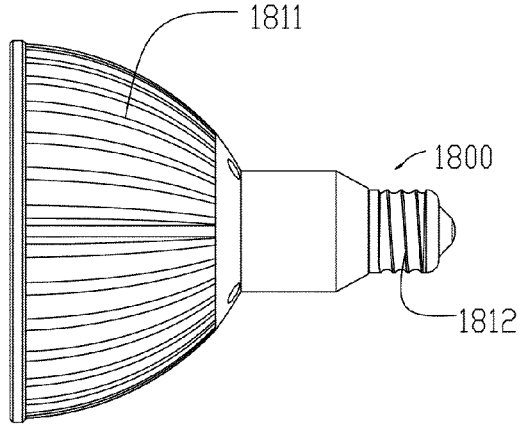

FIGS. 18A-C provide various views of another exemplary spot light bulb according to embodiments of the invention. As shown, this PAR-38 type bulb 1800 can be provided in 85-260V AC input, having red, amber, green, blue, or white color LEDs. This bulb 1800 shows ten lenses 1820 secured by the housing cover plate, through which the lenses protrude by way of holes 1832 through the top surface 1831 of the cover plate. The lamp housing comprises heat sink 1811, cover plate, and base 1812, in addition to other components or features not shown or highlighted herein. Of particular interest in this embodiment is the configuration of heat sink 1811, which provides for dissipation of heat by way of the longitudinally arranged ridges and valleys in the housing surface and cut-outs or vents 1836 around the circumference of the lamp. The heat sink 1811 can comprise ceramic, plastic, metal, combinations and composites thereof, as well as heat pipe technology. The preferred heat sinks 1811 comprise the materials discussed earlier in this application and are preferred for and applicable to all embodiments of the invention. The base 1812 shown is a standard E26/E27 base. Any means can be used for securing the cover plate to the housing, including screws 1834 which are accommodated through holes 1835 in the face 1831 of the cover plate as shown. As discussed above, various configurations for the housings can be used, which will include modifying the diameter of the housing larger or smaller and/or modifying the length of the housing shorter or longer. One advantage to making these modifications can be to increase or decrease the surface area of the heat sink as desired for a particular type bulb, application, or the number of LEDs used.

As can be seen in comparing the heat sinks 1611, 1711, and 1811 respectively of FIGS. 16, 17, and 18, modifications can be made to the lamp assemblies and in particular the disposition of the heat sink can be tailored for particular applications. For example, the number, size, and shape of vents 1636, 1736, or 1836 can be increased or decreased as needed, as well as that of the fins (ridges).

A further object of the present invention is to provide a method of manufacturing a light assembly comprising: (a) positioning one or more lenses above one or more light emitting diodes (LEDs) by using a lens support comprising a recess for each lens, wherein each recess has an interior surface shape complementary to an exterior surface shape of a lens, and wherein each recess has a void capable of encompassing an LED; and (b) installing a cover plate to secure the lenses within a light assembly housing.

The lamp assemblies/bulbs of the present invention can be used for general illumination purposes, safety and security, signaling, backlighting, and for signage and decorative lighting. The lamp assemblies of the present invention can provide lighting in a range of colors, including for example red, yellow, green, blue, warm white, neutral white, and cool white. Further, the bulbs can be dimmable or non-dimmable, and/or programmable or non-programmable.

The present invention has been described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. Other embodiments of the invention will be apparent to those skilled in the art from consideration of the specification and practice of the invention. It is intended that the specification and examples be considered as exemplary in nature and that variations that do not depart from the essence of the invention are intended to be within the scope of the invention.

The invention claimed is:

1. A light assembly comprising:

a housing;

an electrically non-conductive substrate with an electrically conductive pathway;

one or more light emitting diodes (LEDs) operably connected to the pathway;

a lens for each LED having a lower exterior surface;

a lens support having an upper exterior surface, a recess for each lens, and a through hole for each LED, wherein when assembled the lower exterior surface of each lens contacts the upper exterior surface and a recess of the lens support; and a cover plate for securing the lenses and lens support within the housing;

wherein the lower exterior surface of each lens is complementary in shape to the upper exterior surface and recess of the lens support; and wherein the lens support comprises multiple individual lens supports joined together to form an integral lens support having multiple recesses.

2. The light assembly according to claim 1, wherein each lens is individual.

3. The light assembly according to claim 1, wherein the lower exterior surface of each lens has a portion of which is a side surface of the lens and when assembled each lens is seated totally within a recess of the lens support and the side surface of the lens fits completely within the recess of the lens support.

4. The light assembly according to claim 1, wherein an outline of the lower exterior surface shape of each lens matches an outline of the upper exterior surface and a recess of the lens support.

5. The light assembly according to claim 1, wherein the multiple individual lens supports are joined together with releasable connections.

6. The light assembly according to claim 4, wherein the lens support and corresponding lens are capable of slideable and releasable engagement.

7. The light assembly according to claim 1, further comprising heat sink capabilities provided by one or more thermally conductive materials integral with the housing and disposed by way of any combination of ridges, troughs, and vents.

8. The light assembly according to claim 7, wherein one or more of the thermally conductive materials is chosen from iron, aluminum, copper, silver, gold, polyamide, polyphenylene sulfide, a heat pipe, or any combination thereof.

9. A light assembly comprising:

a housing;

an electrically non-conductive substrate with an electrically conductive pathway;

one or more light emitting diodes (LEDs) operably connected to the pathway;

a lens for each LED having a lower exterior surface;

a lens support having an upper exterior surface, a recess for each lens, and a through hole for each LED, wherein when assembled the lower exterior surface of each lens contacts the upper exterior surface and a recess of the lens support; and a cover plate for securing the lenses and lens support within the housing;

wherein the lower exterior surface of each lens matches an outline of the upper exterior surface and recess of the lens support; and wherein the outlines of the upper exterior surface of the lens support and the lower exterior surface of the lens comprise at least a portion of which is a conical shape.

10. The light assembly according to claim 9, wherein each lens is individual.

11. The light assembly according to claim 9, wherein the lower exterior surface of each lens has a portion of which is a side surface of the lens and when assembled each lens is seated totally within a recess of the lens support and the side surface of the lens fits completely within the recess of the lens support.

12. The light assembly according to claim 9, wherein the lens support comprises multiple individual lens supports joined together to form an integral lens support having multiple recesses.

13. The light assembly according to claim 9, wherein the lens support is of single-piece construction.

14. The light assembly according to claim 12, wherein the multiple individual lens supports are joined together with releasable connections.

15. The light assembly according to claim 9, wherein the lens support and corresponding lens are capable of slideable and releasable engagement.

16. The light assembly according to claim 9, further comprising heat sink capabilities provided by one or more thermally conductive materials integral with the housing and disposed by way of any combination of ridges, troughs, and vents.

17. The light assembly according to claim 16, wherein one or more of the thermally conductive materials is chosen from iron, aluminum, copper, silver, gold, polyamide, polyphenylene sulfide, a heat pipe, or any combination thereof.

18. A method of manufacturing a light assembly comprising:

installing one or more individual lenses in a light assembly housing by positioning each lens in a lens support comprising a top surface and a recess for each lens, whereby each lens has a lower exterior surface that is complementary in shape to and contacts the recess and the top surface of the lens support; and installing a cover plate to secure the lenses and support within the housing;

wherein the lens support comprises multiple individual lens supports joined together to form an integral lens support having multiple recesses.

19. The method according to claim 18, wherein the lower exterior surface of each lens has a portion of which is a side surface of the lens and when assembled each lens is seated totally within a recess of the lens support and the side surface of the lens fits completely within the recess of the lens support.

20. The method according to claim 18, wherein the lower exterior surface shape of the lens matches that of the recess and the top surface of the lens support on and in which it is positioned.

21. The method according to claim 18, wherein the multiple individual lens supports are joined together with releasable connections.

22. The method according to claim 18, wherein each recess and corresponding lens are capable of slideable and releasable engagement.

* * * * *